US011450501B2

(12) United States Patent
Andaluz Sorlí

(10) Patent No.: US 11,450,501 B2
(45) Date of Patent: Sep. 20, 2022

(54) FUSE SWITCH MODULE

(71) Applicant: Gorlan Team, S. L. U, Amorebieta (ES)

(72) Inventor: Jose Oscar Andaluz Sorlí, Saragossa (ES)

(73) Assignee: GORLAN TEAM, S. L. U, Amorebieta (ES)

( * ) Notice: Subject to any disclaimer, the term of this patent is extended or adjusted under 35 U.S.C. 154(b) by 16 days.

(21) Appl. No.: 16/985,828

(22) Filed: Aug. 5, 2020

(65) Prior Publication Data

US 2021/0043406 A1 Feb. 11, 2021

(30) Foreign Application Priority Data

Aug. 6, 2019 (EP) ..... 19382689

(51) Int. Cl.

| | |
|---|---|
| ***H01H 85/045*** | (2006.01) |
| ***H01H 85/165*** | (2006.01) |
| ***H01H 89/00*** | (2006.01) |
| ***H01H 85/20*** | (2006.01) |
| ***H01H 85/22*** | (2006.01) |
| ***H01H 85/60*** | (2006.01) |

(52) U.S. Cl.

CPC ..... *H01H 89/00* (2013.01); *H01H 85/045* (2013.01); *H01H 85/165* (2013.01); *H01H 85/205* (2013.01); *H01H 85/22* (2013.01); *H01H 85/60* (2013.01)

(58) Field of Classification Search

CPC .... H01H 85/045; H01H 85/165; H01H 85/22; H01H 85/60; H01H 85/545; H01H 9/102; H01H 1/2041

See application file for complete search history.

(56) References Cited

U.S. PATENT DOCUMENTS

| | | | | |
|---|---|---|---|---|
| 3,406,365 A | | 10/1968 | Lameyre | |
| 4,559,504 A | * | 12/1985 | Krec | H01H 85/26 337/194 |
| 6,727,797 B1 | * | 4/2004 | Bruchmann | H01H 9/104 337/194 |

(Continued)

FOREIGN PATENT DOCUMENTS

| | | |
|---|---|---|
| DE | 1788050 A1 | 1/1972 |
| EP | 1 770 729 A1 | 4/2007 |

(Continued)

*Primary Examiner* — Stephen S Sul

(74) *Attorney, Agent, or Firm* — Seed Intellectual Property Law Group LLP

(57) ABSTRACT

The invention refers to a fuse switch module (1) that comprises a casing (2) having an aperture (3) and a cover (4) for closing and opening the aperture (3), and a rotatable fuse cartridge (11) for receiving a fuse (8). The fuse cartridge (11) is rotatable between a switch module closed position in which a fuse (8) is connected with fixed contacts (5,6) to enable current circulation, and a switch module open position in which current circulation through the fixed contacts (5,6) is impeded. The cover (4) and the fuse cartridge (11) are engaged when the cover (4) is closing the aperture (3) and when the fuse cartridge (11) is in the switch closed position, thus, the cover (4) is locked by the fuse cartridge (11) and opening of the cover (4) is impeded while current is circulating through the switch module.

17 Claims, 22 Drawing Sheets

(56) References Cited

U.S. PATENT DOCUMENTS

| | | | | |
|---|---|---|---|---|
| 6,759,939 | B2 * | 7/2004 | Sudan | H01H 11/0031 337/208 |
| 6,794,979 | B2 * | 9/2004 | Sudan | H01H 85/0091 337/208 |
| 8,310,333 | B2 * | 11/2012 | Ventura | H01H 85/545 337/211 |
| 9,136,083 | B2 * | 9/2015 | Brakefield | H01R 9/03 |
| 2005/0285710 | A1 * | 12/2005 | Buettner | H01H 85/545 337/231 |
| 2008/0048819 | A1 * | 2/2008 | Darr | H01H 85/30 337/206 |
| 2012/0056708 | A1 * | 3/2012 | Ventura | H01H 9/104 337/207 |
| 2013/0015940 | A1 | 1/2013 | Dunker | |
| 2013/0133716 | A1 * | 5/2013 | Buettner | H01H 9/102 136/244 |
| 2013/0187747 | A1 * | 7/2013 | Reibke | H01H 85/202 337/213 |
| 2014/0009255 | A1 * | 1/2014 | Lu | H01H 85/60 337/180 |

FOREIGN PATENT DOCUMENTS

| | | | |
|---|---|---|---|
| GB | 188820 | A | 11/1922 |
| GB | 332414 | A | 7/1930 |
| WO | 01/08100 | A1 | 2/2001 |
| WO | 01/08180 | A1 | 2/2001 |
| WO | 2009/037022 | A1 | 3/2009 |

* cited by examiner

FUSE SWITCH MODULE

FIELD AND OBJECT OF THE INVENTION

The present invention refers in general to the construction of switches incorporating overcurrent protection fuses.

An object of the invention is to provide a fuse switch incorporating security means so an operator can safely carry out maintenance and inspection task of the switch.

Another object of the invention is to provide an efficient fuse switch, that causes very small power losses during stationary state of the switch.

An additional object of the invention a low cost fuse switch, that can be constructed with a low number of components and that features a compact design.

BACKGROUND OF THE INVENTION

Fuses are widely used in electrical circuits to protect electrical or electronic components from electrical over-currents, so that when electrical current through a fuse exceeds a predetermined limit, the fuse melts and current circulation through the fuse is interrupted and components damage is thereby prevented.

It is also known to use fuses, not only as a protection element against over-currents, but also for switching purposes by connecting or disconnecting a fuse form a circuit, so that, an electrical circuit is closed or interrupted through the fuse.

For example, the U.S. Patent application US 2013/015940 is an example of a switch incorporating a fuse, wherein the fuse is housed in a fuse holder having terminals that are electrically coupled to a circuitry. When conductive portions of the fuse, such as fuse blades are engaged to the fuse holder terminals, an electrical circuit is formed through the fuse, and when conductive portions of the fuse are disengaged from the fuse holder terminals, the electrical circuit through the fuse is broken. Therefore, by inserting and removing the fuse to and from the fuse holder terminals, a fused disconnect switch is realized.

Typically, in this type of fuse switches, the fuse has always been conceived as a static component during the stationary state of the switch, with the only purpose of protecting against over-currents, that is, the fuse has been always been conceived as an complementary component to the switch itself. For the connection of the fuse in the switch, it is necessary to provide ancillary components, like a fuse holder, blades and electric connections with the switch contacts, so that manufacturing cost, complexity and size of these switches, are increased by the provision of these ancillary components.

Additionally, each electric connection between those ancillary components are "hot spots", that causes power losses, thus, the larger the number of interconnections, the larger the power losses.

Nevertheless, switches using a fuse as rotary contact of the switch are also known from the following patent publications: GB-188.820, U.S. Pat. No. 3,406,365, GB-332.414, WO 01/08100, and DE-1788050. These proposed fused switches have the drawback that an operator might attempt to access the fuse for its inspection or replacement, when the fuse is in the switch conducting position, bearing the risk therefore of an accidental electric discharge if the operator get in contact with one of the electric terminals.

Other type of devices incorporating fuses are fuse holder bases that are used for engaging or disengaging electric fuses in electric installations. These fuse holder bases generally comprises a base attachable to the busbars of an installation, and a cover pivotally attached to the base and incorporating a fuse, such as the fuse is angularly movable with respect to the base. The fuse holder can have two positions: an operative or engaged position, in which connection is established; and a disengaged position, in which the cover and the fuse are tilted with respect to the base, therefore disengaged.

The PCT patent application WO 2009/037022 is an example of these fuse holder bases. It can be noted for example in FIG. 1 of this PCT publication, that the pivot axis (8) is located at one end of the fuse base.

Even if fuse holders bases actually operate as switches, their main purpose is simply to provide access to the fuse for replacement or maintenance task, but generally these are not used as main switches of an electric installation.

It is desirable in this technical field, to provide low-cost switches, that a safe to operate, that features low power losses and that are sustainable.

SUMMARY OF THE INVENTION

The present invention is defined in the attached independent claim, and it refers to a fuse switch module in which the fuse has a double function, as a fuse and at the same time as an integral part of the switch mechanism, to operate as moving contact of the switch for the transition between the open and closed positions of the switch, by interconnecting and disconnecting a pair of fixed contact of the switch.

More in detail, an aspect of the invention refers to a fuse switch module that comprises an electrically insulating casing having an aperture providing access to the casing interior, and a cover or door installed at the aperture in movable manner for opening and closing the aperture. The cover is movable between a closed position in which it is covering the aperture so that the casing interior is not accessible from outside the casing, and an open position in which the casing interior is accessible from the exterior.

Conventionally, the fuse switch module has at least a pair of fixed contacts placed inside the casing, that are accessible through openings of the casing for connecting the switch module with an external circuit.

The fuse switch module incorporates a rotatable fuse cartridge made of an electrically insulating material that it is placed inside the casing, and it is configured for receiving a conventional overcurrent protection fuse, so that when a fuse is coupled with the fuse cartridge, the fuse and the fuse cartridge are jointly rotatable.

The fuse cartridge is rotatable between a switch module closed position in which a fuse would be connected with the fixed contacts to enable current circulation through the fuse and the fixed contacts when a fuse is received in the fuse cartridge, and a switch module open position in which the fuse is not in contact with fixed contacts, that is, the fuse is separated or distanced (electrically isolated) from the fixed contacts, so that current circulation through the fixed contacts is impeded.

Therefore, by rotating the fuse cartridge the switch module reciprocally transit from the switch module closed positon to the switch module open position (and vice versa).

According to the invention, the fuse cartridge and the cover are configured in such a way that the cover can be locked by the fuse cartridge to impede opening of the cover in the switch module closed position. With that configuration, the switch module of the invention implement a security measure, ensuring that, when the switch module is in use and while current is allowed to circulate through the fuse and fixed contacts, the fuse cannot be acceded. In this way, an operator trying to get access to the fuse, for example for inspection or maintenance, could not get access to the fuse, thereby preventing any hazard of accidental electric discharge.

Only when the switch is opened and no current is circulating, and operator could open the cover and get access to the fuse, for example for its replacement.

More in detail, the cover and the fuse cartridge are configured to engage with each other when the cover is closing the aperture and when the fuse cartridge is in the switch closed position, so that the cover is locked by the fuse cartridge and opening of the cover is impeded. In the switch module open position, the cover and the fuse cartridge are not engaged, then the cover can be freely be open allowing access to the fuse.

Preferably, the cover and the fuse cartridge have interlocking hooks that engage with each other in the closed position of the switch module, and when the cover is closing the aperture to impede opening of the cover.

In use, the switch module is connected with an electric installation and an overcurrent protection fuse is fitted in the fuse cartridge, so as to limiting maximum current circulation through the switch module in a known manner. Typically, a fuse is a cylindrical body having a longitudinal axis (L) and two connection terminals at opposite ends of the fuse body.

The fuse is rotatable about a rotation axis (X) that runs transversally across the fuse body in-between the two connection terminals, therefore, the two terminals move on the same plane when the fuse is rotated above the axis (X).

Preferably, the fuse cartridge and the fuse can rotate about the rotation axis (X) an angle ($\alpha$) within the range 45°-90° between the closed and open positions. Preferably the angle ($\alpha$) is 90°.

According to the invention, the fuse is detachable from the fuse cartridge by moving, (either pulling or pushing) the fuse axially, that is, in the direction of its longitudinal axis (L).

Additionally, the relative arrangement between the aperture, the cartridge and the fixed contacts is selected, in such a way that in the open position of the switch module, the fuse can be extracted out of the casing trough the aperture. For that purpose, the longitudinal axis (L) of the fuse passes through the aperture (3), preferably the axis (L) of the fuse is orthogonal to the aperture (assuming that the aperture lies on a plane).

The cover and the cartridge are elongated bodies along respective longitudinal axis, and the cover and the cartridge are configured and arranged, so that in the switch module closed position and when the cover is closing the aperture, their longitudinal axis are parallel to each other, to impede extraction of the fuse.

As an additional security feature, blocking means are provided in the switch module to block the fuse cartridge in the switch module open position, in order to impede rotation of the fuse cartridge towards the switch module closed position and while the cover is open. With this security feature, it is assured that while an operator is manipulating the fuse through the aperture in the switch open position, the switch would not be accidentally turned to the closed position.

In a preferred embodiment, the blocking means comprise a protrusion, for example a pin protruding laterally in the cartridge and slider movable by the cover. When the cover is opened, the slider is positioned to be contacted by the protrusion to block rotation of the fuse cartridge. When the cover is closing the aperture, the slider is moved to a position where rotation of the fuse cartridge is allowed.

The cover is pivotably mounted at the aperture, and the slider is a plate connected in an articulated manner with a pivot axis of the cover. The slider has a curved groove on one of the plate faces so that the protrusion runs along the groove with the rotational movement of the cover. The cover is an elongated body having two ends, and in one of its ends there is a pivot axis about which the cover is pivotable, and in the other end there is an interlocking hook.

Furthermore, the switch module comprises a pair of conductive blades detachably coupled respectively with the fuse terminals, and configured for contacting with a fixed contact in the closed position of the switch module. The material of the connection terminals of the fuse is not suitable to be used as contacts of a switch, thus it would worn away easily as a result of the electric arc that is generated during the switching operations. Using the conductive blades has the advantage that they are manufactured with a suitable material.

The conductive blade has a coupling part to be coupled with a fuse terminal, and a contacting part provided for contacting with a fixed contact. The contacting part is asymmetrical and include a triangular shape, that the long lateral edge is longer than the short lateral edges. The two lateral edges are parallel. Preferably, the contacting part has a long lateral edge and a short lateral edge such as an end part of the long lateral edge is closer to the respective fixed contact to be contacted, than the short lateral edge.

Preferably, the two conductive blades are identical pieces.

The switch module additionally comprises a fuse carrier coupled with the fuse. The fuse carrier has an end adapted to be gripped and configured to pull the fuse axially out of the fuse cartridge. Preferably, the cover is configured to engage with the fuse carrier when the cover is closing the aperture, so that by opening the cover the fuse carrier is pulled out by the cover.

The switch module additionally comprises a fuse extractor pivotally mounted with the cover between two end positions: an extended position in which it is engaged with the fuse carrier when the cover is closing the aperture, and a retracted position in which it is concealed inside the cover and distanced from the fuse carrier.

The fuse cartridge has two protrusions having a bore for receiving an actuation member for operating the switch module. The protrusions are received within respective circular apertures formed at lateral walls of the casing and accessible from the outside the casing, in such a way that rotation of the fuse cartridge is guided by the apertures.

The inventions also refers to a switch assembly or array that comprises two or more fuse switch modules as the one defined above, assembled together about a common operating axis, thus, the fuse cartridges of the switch modules are coupled so as to simultaneously rotate.

Each fuse cartridge has a fuse received inside and conductive blades coupled respectively with the fuse terminals. In a preferred embodiment, at least one of the switch modules has the two conductive blades arranged so that the long lateral edges of the two conductive blades are closer to the center of the fuse than the short lateral edges (advanced arrangement), and wherein at least one of the switch modules has the two conductive blades arranged so that the long lateral edges of the two conductive blades are closer to the fuse free opposite ends than the short lateral edges (delayed arrangement).

With the above-described blades arrangement, when the switch modules are to be closed, the switch module having the conductive blades in the advanced arrangement would be closed before the switch module having the conductive blades in the delayed arrangement. In turn, when the switch modules are to be opened, the switch module having the conductive blades in the delayed arrangement would be opened before the module having the conductive blades in the advanced arrangement.

This feature has the advantage that in a switch assembly, the switch module used for the neutral pole can be closed before the other poles and it can be opened after the other poles are opened, so as to increase safety of the switch assembly.

BRIEF DESCRIPTION OF THE DRAWINGS

Preferred embodiments of the invention are henceforth described with reference to the accompanying drawings, wherein.

PREFERRED EMBODIMENT OF THE INVENTION

Figure 1:
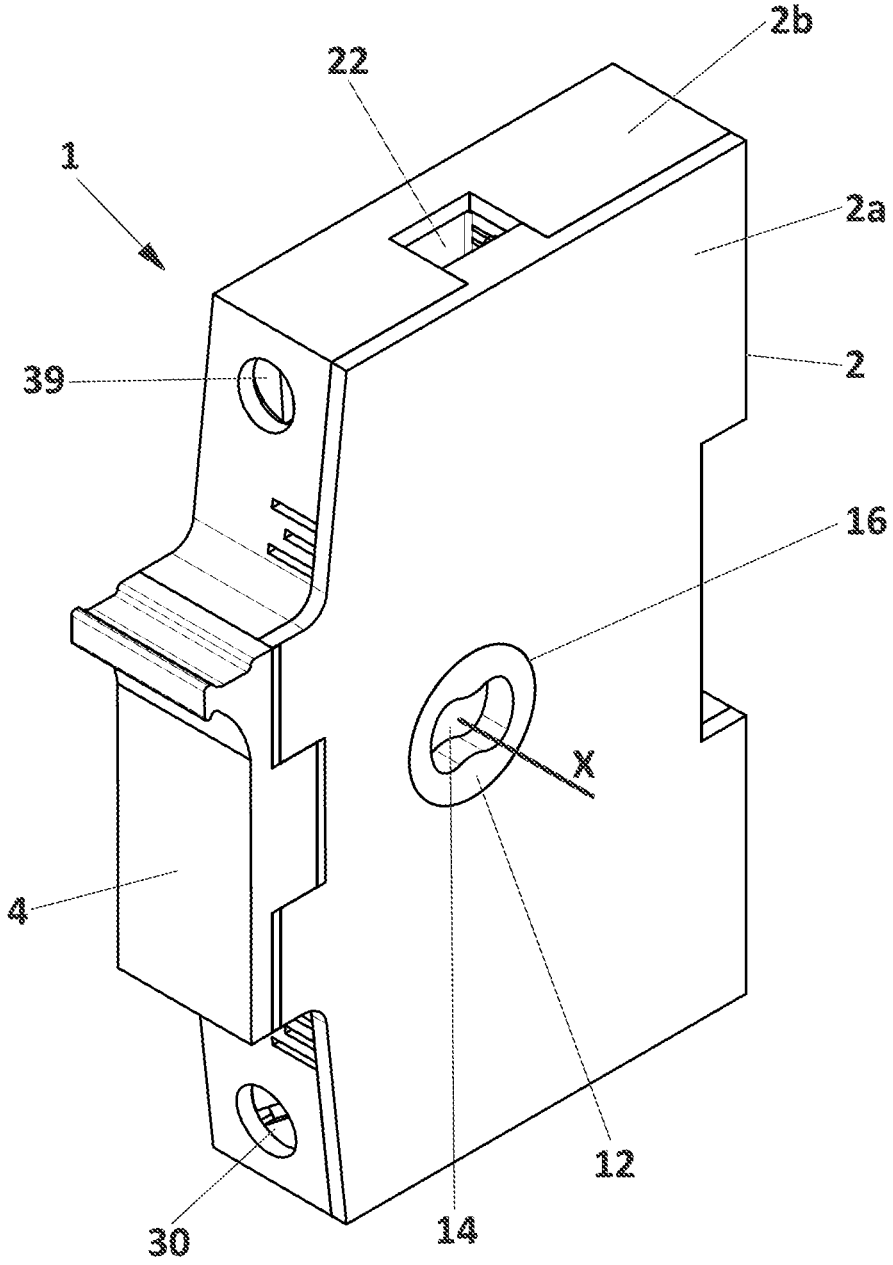
FIG. 1.—shows a perspective view of a first preferred embodiment of a switch module according to the invention.
Figure 2:
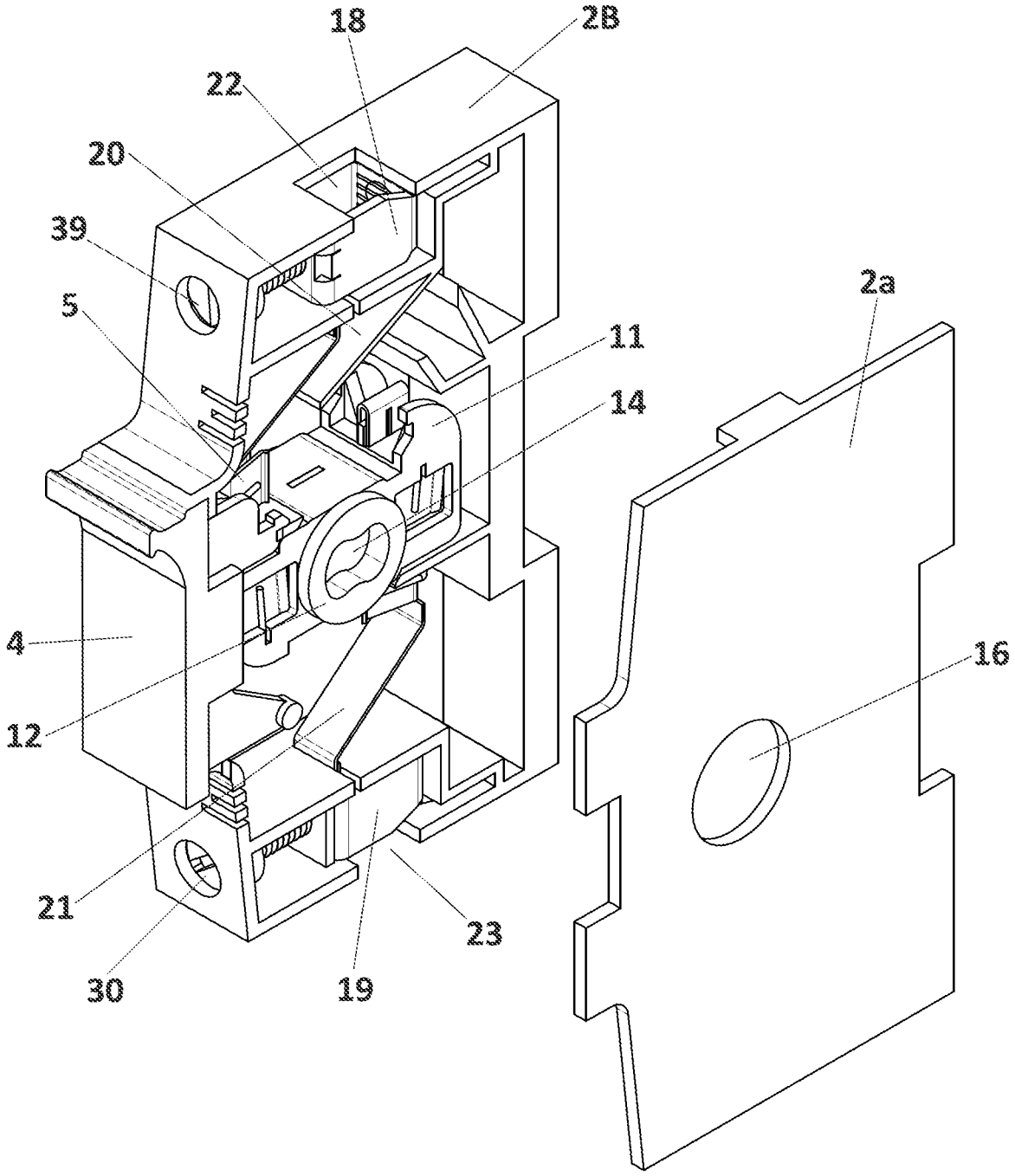
FIG. 2.—shows another perspective view with one of the casing walls represented in exploded view.

FIG. 1 shows a first preferred embodiment of a fuse switch module (1) according to the invention, comprising an electrically insulating casing (2) formed by two coupled parts (2*a*,2*b*) that form together an enclose within which fixed contacts (5,6) and a fuse (8) of the switch are housed. The casing (2) has an aperture (3) in a front wall of the casing, and a cover (4) covering the aperture (3). The cover (4) is pivotally mounted on the casing (2) so when the cover (4) is open (as shown in FIG. 7), the casing interior is accessible through the aperture (3) for extracting the fuse (8) out of the casing.

Figure 5:
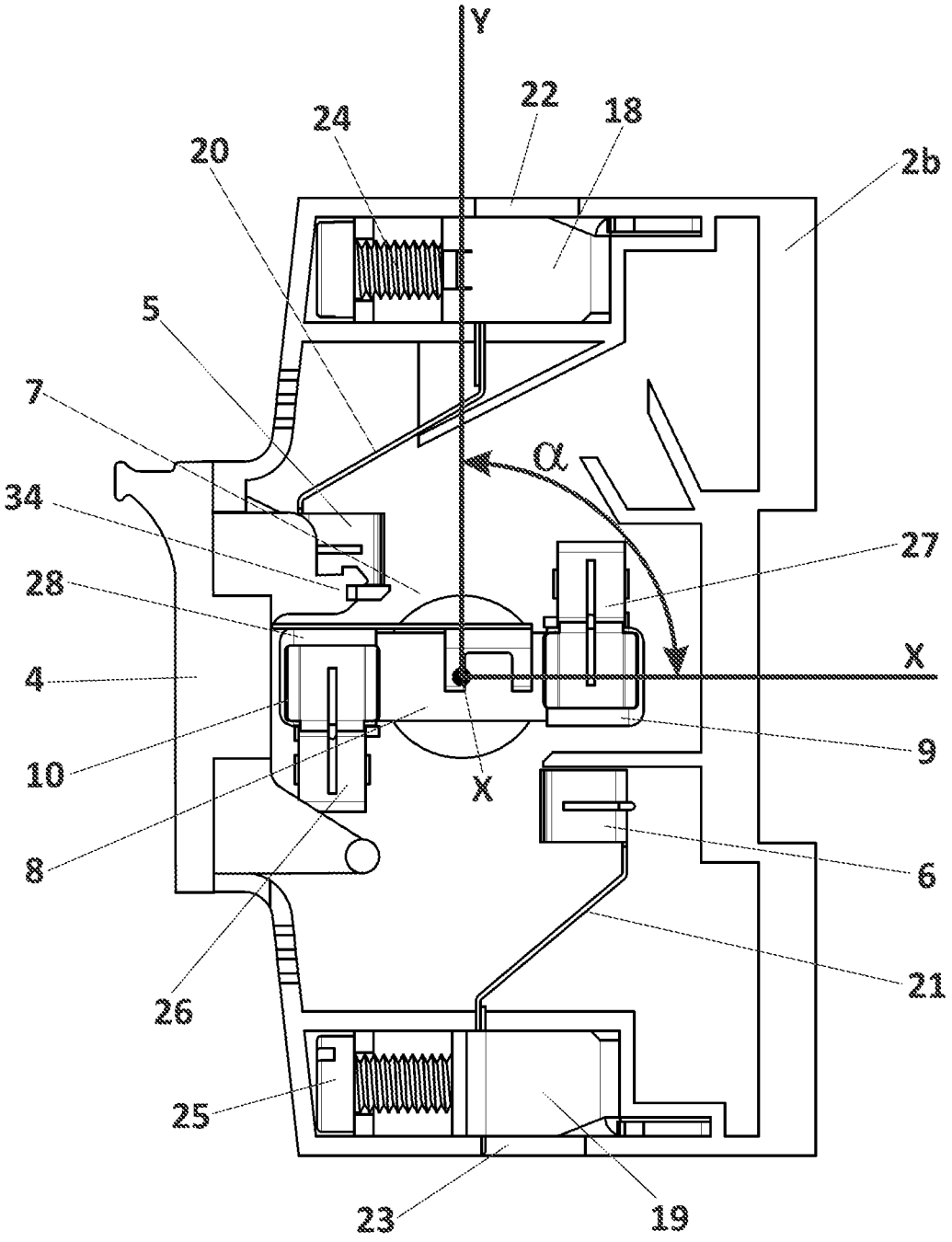
FIG. 5.—shows a side elevational view in the open position of the switch, and with the fuse cartridge removed for the sake of the illustration.
Figure 6:
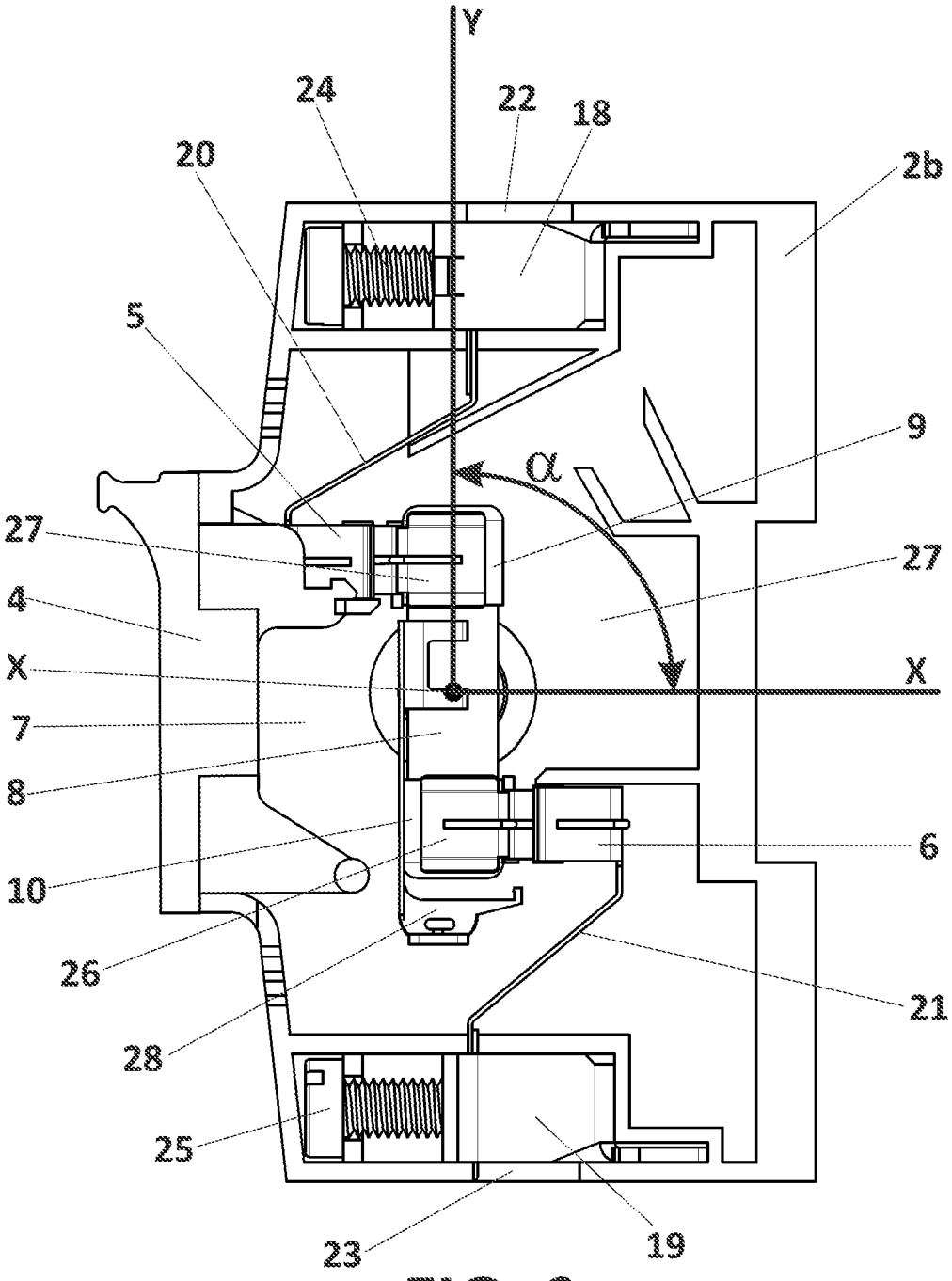
FIG. 6.—shows a similar representation than FIG. 5 but in the closed position of the switch.
Figure 7:
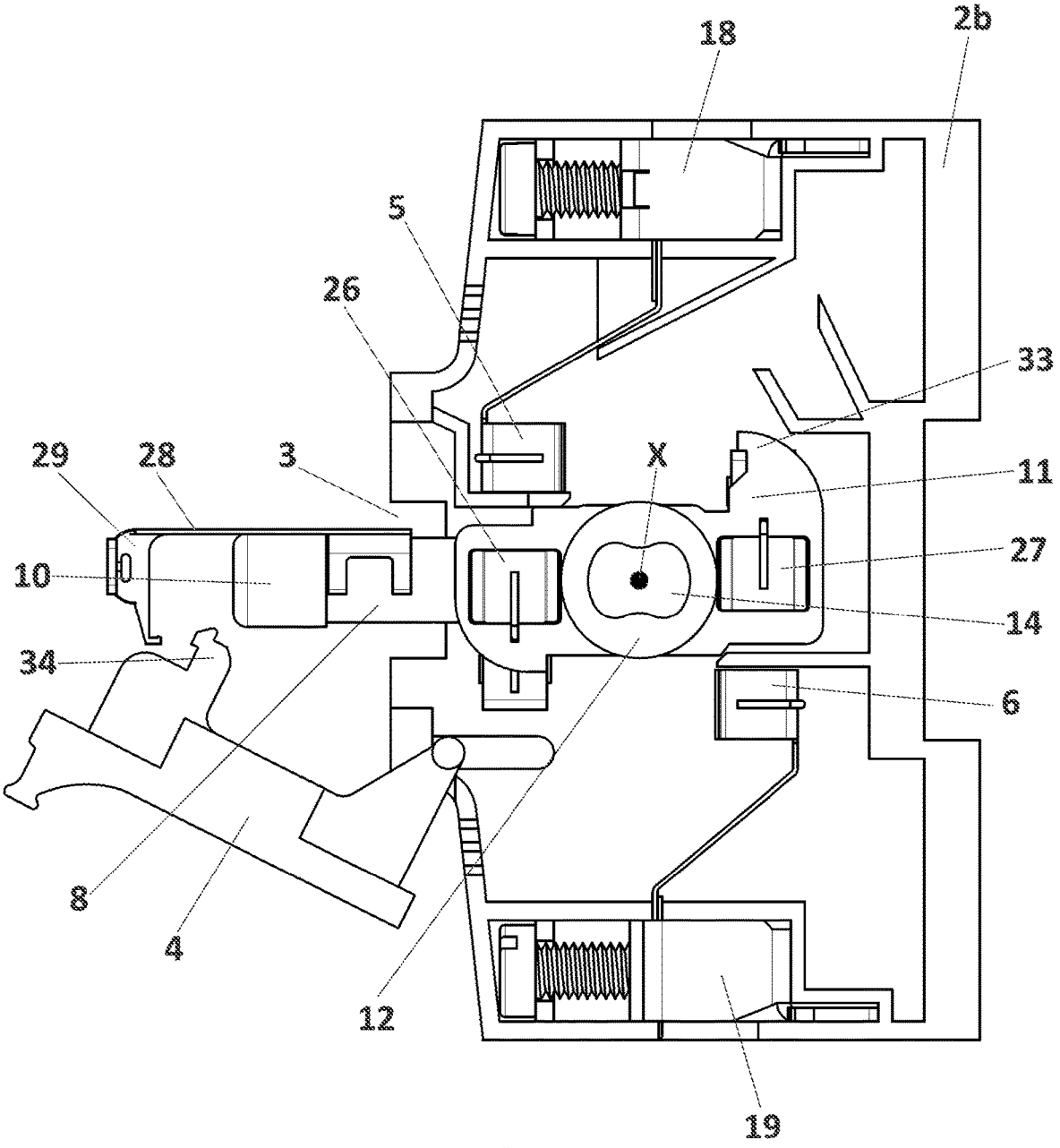
FIG. 7.—shows another side elevational view with the fuse partially extracted out of the casing.

The switch module (1) further comprises a pair of fixed contacts (5,6) in the form of tweezers, and a rotary contact (7) rotatable about a rotation axis (X) located in-between the fixed contacts (5,6), as shown more clearly in FIGS. 5-7. The switch module (1) has an overcurrent protection fuse (8) that is part of the rotary contact (7), so that the fuse (8) is rotatable about the axis (X) between a closed position (FIG. 6) in which it is connected with the fixed contacts (5,6) to enable current circulation, and an open position (FIG. 5) in which the fuse (8) is electrically isolated (distanced) from the pair of fixed contact (5,6) to prevent current circulation.

Therefore, the fuse (8) operates as the rotary contact (7), so by rotating the fuse (8) about the rotation axis (X), the switch transit from the closed to the open position and vice-versa.

The fuse (8) is an elongated body and has two connection terminals (9,10) at opposite ends of the fuse. The rotation axis (X) runs transversally across the fuse (8) (transversal to the longitudinal direction of the fuse), and it is located in-between the two connection terminals (9,10), so that, the fuse is rotatable on a plane. The switch module (1) is configured such the fuse (8) rotates about the rotation axis (X) an angle ($\alpha$) between the open position (FIG. 5) and closed position (FIG. 6). The angle ($\alpha$) is within the range (45°-90°, and preferably the angle ($\alpha$) is 90° as indicated in FIG. 5.

The switch module (1) has a fuse cartridge (11) made of an electrically insulating material, such as the fuse (8) is fitted inside the cartridge (11) during the normal use of the switch, so both components cartridge (11) and fuse (8) can rotate together about the axis (X). For that, the fuse cartridge (11) has two lateral protrusions (12,13) with circular configuration and having respective bores (14,15) for receiving an actuation shaft (not shown) for rotating the fuse cartridge (11) to operate the switch. These circular protrusions (12,13) are received respectively within circular windows (16,17) formed in the lateral walls of the casing (2), so that the rotation of the cartridge (11) is guided by the windows (16,17).

Figure 3:
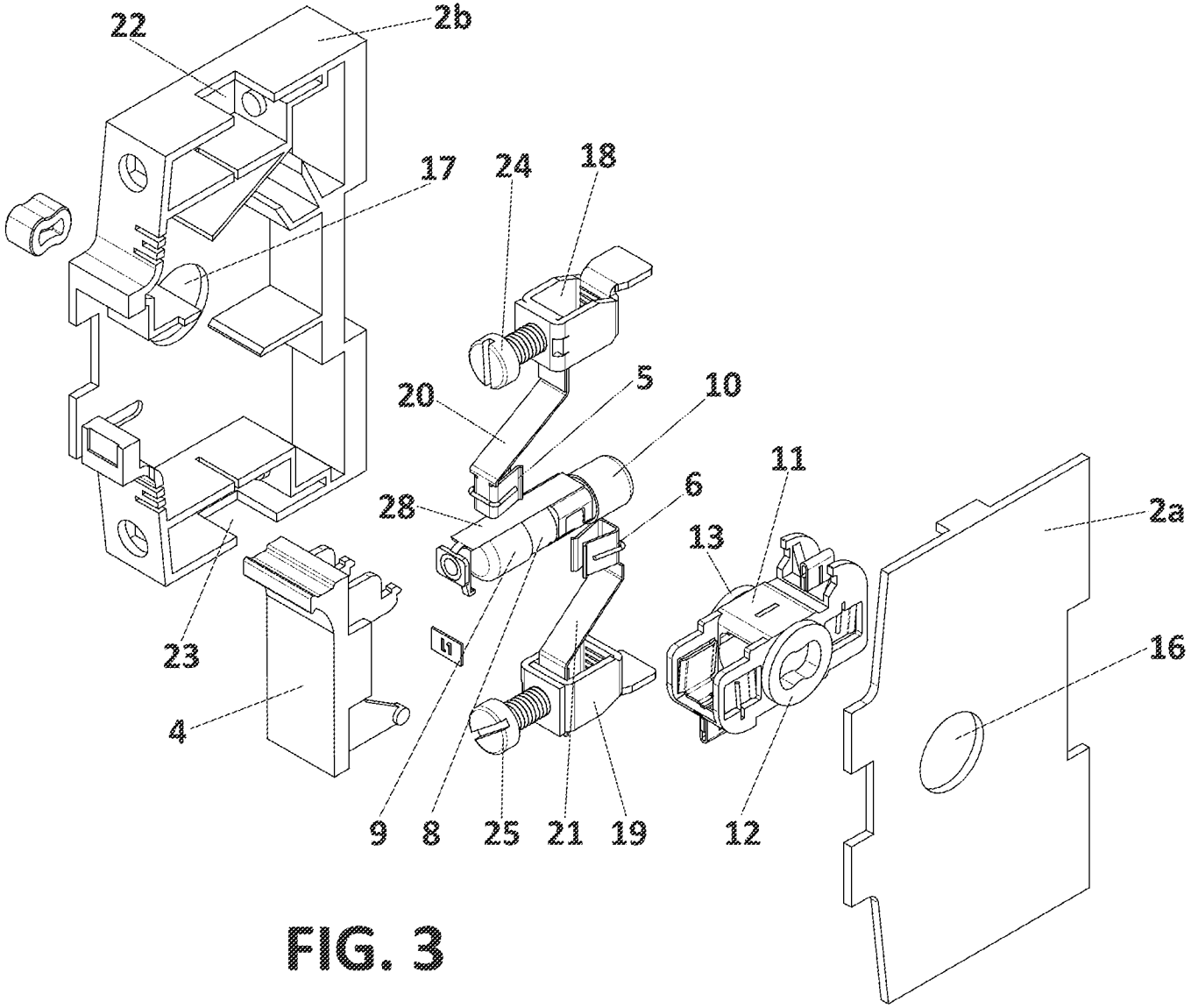
FIG. 3.—shows another exploded view of the switch module.

The switch module (1) further comprises a pair of switch terminals (18,19) enclosed within the casing (2) respectively connected with the fixed contacts (5,6) by means of connections (20,21) as shown more clearly in FIG. 3. These terminals (18,19) are accessible through upper and lower windows (22,23) provided at the casing, for their connection with an external electric circuit (not-shown), for example for their connection with wires that can be secured by means of screws (24,25) in known manner accessible through openings (39,30) at the front face of the casing (2) in which the aperture (3) is formed.

Figure 4:
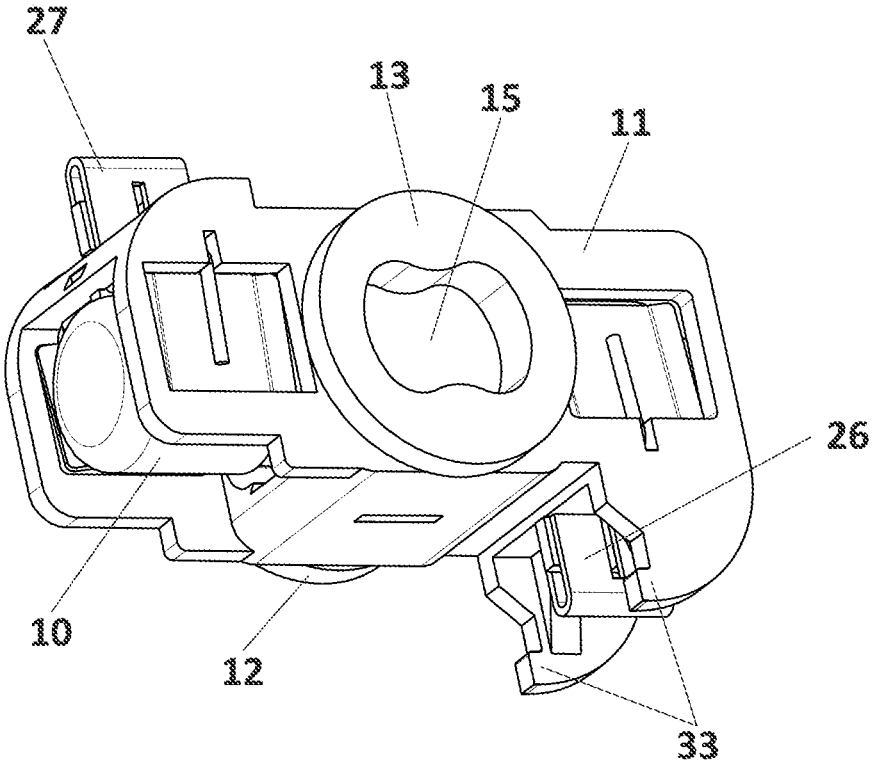
FIG. 4.—shows a perspective view of the fuse cartridge and the fuse coupled together.

The fuse cartridge (11) is represented in FIG. 4 in more detail, and it is configured to receive the fuse (8) such as, in use, the two connection terminals (9,10) can be connected with the fixed contacts (5,6) by means of a pair of blades (26,27) detachably coupled respectively with fuse terminals (9,10). The blades (26,27) protrude outside the fuse cartridge (11) in opposite directions, and are configured for contacting with the fixed contacts (5,6) in the closed position of the switch module (1).

Each blade (26,27) has generally an "Y" shape in a cross-sectional view of the same, and it is configured such as its double-walled part embraces one of the fuse contacts (9,10) by elastic deformation as shown in FIG. 4, and the single-wall part of the blade can be inserted into one of the fixed contacts (5,6) as shown in FIG. 6.

A fuse carrier (28) is provided for extracting the fuse (8) out of the casing (2) for its replacement or for inspection purposes. The fuse carrier (28) is coupled with the fuse (8), and it is configured to pull the fuse (8) axially out of the casing (2) as shown in FIG. 7, by pulling one end (29) of the fuse carrier (28), either by hand or with the aid of a proper tool.

The cover (4) and the fuse cartridge (11) are configured to engage with each other when the cover (4) is closing the aperture (3) and when the fuse cartridge (11) is in the switch closed position, the cover (4) is locked by the fuse cartridge (11) and opening of the cover (4) is impeded. For that, the cover (4) and the fuse cartridge (11) of FIG. 7 have interlocking hooks (33,34) that engage with each other in the closed position of the switch module and when the cover (4) is closing the aperture (3) to impede opening of the cover (4).

A second preferred embodiment is represented in FIGS. 8 to 14, which has all the features and functionalities described above of the first embodiment, and additionally incorporating the features and functions described here and after.

Figure 8A:
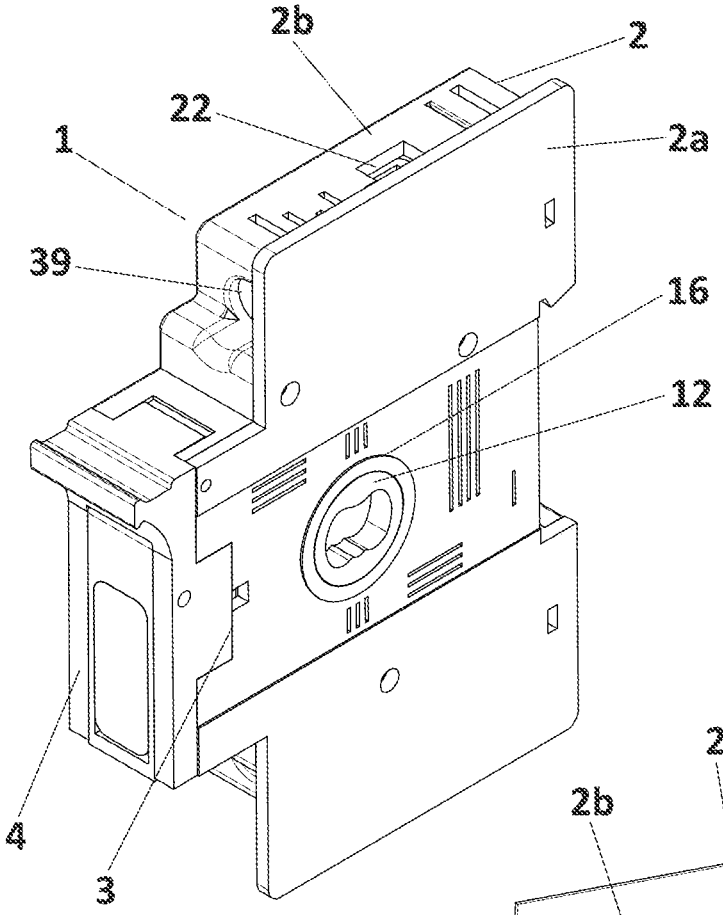
FIG. 8.—shows in FIGS. 8A, 8B, two perspective views of a second preferred embodiment of the invention.
Figure 8B:
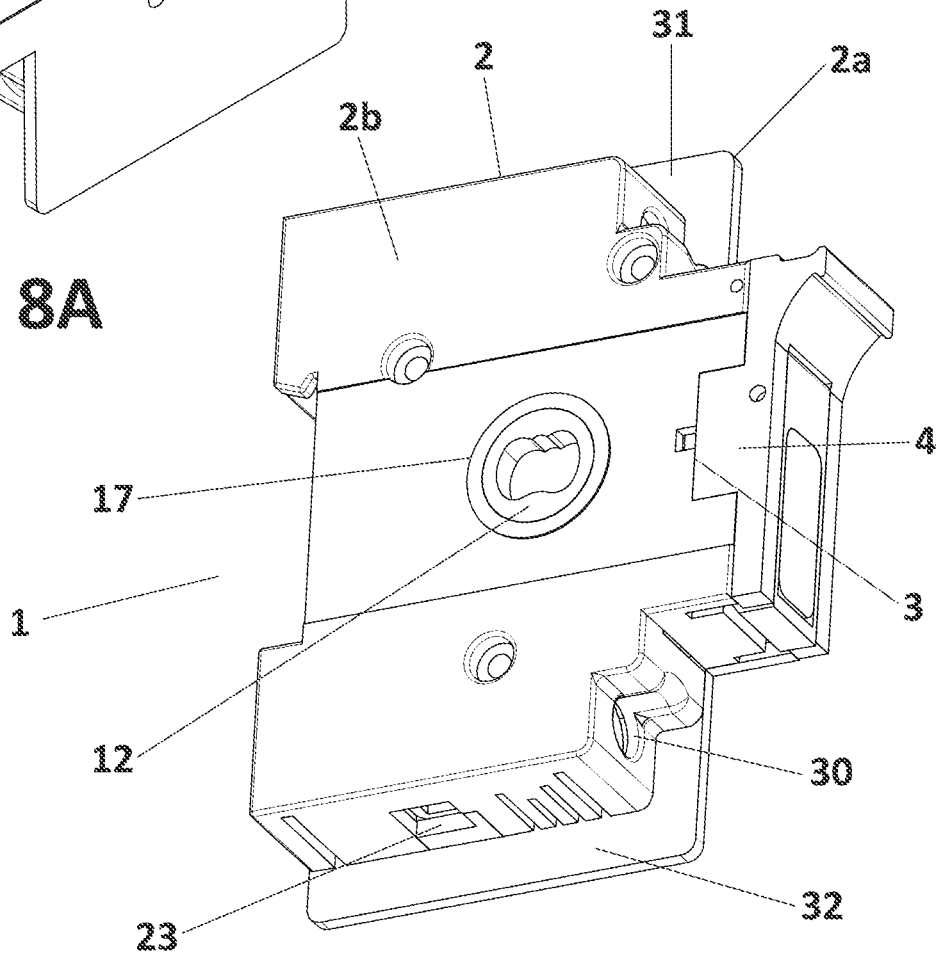
Figure 14:
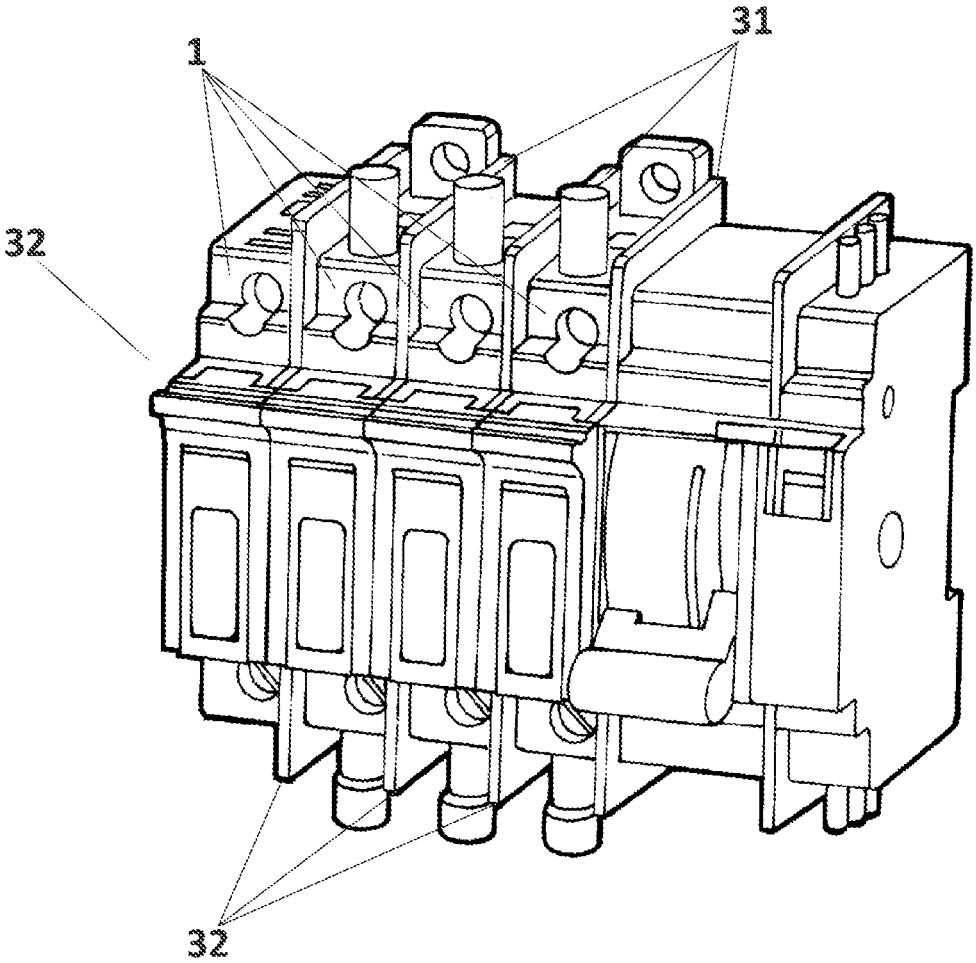
FIG. 14.—shows a perspective view of a switch assembly.

The fuse switch module (1) of FIG. 8 also includes an electrically insulating casing (2) generally rectangular and formed by two coupled parts (2*a*,2*b*) that form together an enclose within which fixed contacts (5,6) and a fuse (8) of the switch are housed. On part of the housing (2*b*) is a flat plate, and the other part (2*a*) is shaped as a tray having a flat base and a lateral wall around the flat base. The flat part (2*a*) is longer than the other part (2*a*) in such a way that separating walls (31,32) are formed at upper and lower part of the module (1) that serve to isolate adjacent switch modules forming part of an assembly (32) of modules as shown in FIG. 14.

The fuse switch module (1) has an aperture (3) providing access to the casing (2) interior, and a cover (4) installed at the aperture (3) in movable manner for opening and closing the aperture (3).

As shown in FIGS. 9 A,B,C the switch module (1) incorporates a pair of fixed contacts (5,6) placed inside the casing (2), and a pair of switch terminals (18,19) enclosed within the casing (2) respectively connected with the fixed contacts (5,6) by means of connections (20,21).

A rotatable fuse cartridge (11) made of an electrically insulating material is placed inside the casing (2). The fuse cartridge (11) is rotatable about a rotation axis (X) located in-between the fixed contacts (5,6) and transversal to the longitudinal axis of the fuse cartridge (11), so that the fuse cartridge (11) can rotate about the rotation axis (X) an angle ($\alpha$) between the switch module closed and open positions. Preferably, the angle ($\alpha$) is within the range 45°-90°, preferably 90°. The contacts (5,6) are diametrically arranged with respect to the axis (X).

The fuse cartridge (11) is adapted for receiving a fuse (8), so that when a fuse (8) is received in the fuse cartridge (11), the fuse (8) and the fuse cartridge (11) are jointly rotatable. The fuse cartridge (11) is rotatable between a switch module closed position (FIG. 9C) in which a fuse (8) is connected with the fixed contacts (5,6) to enable current circulation through a fuse (8) and the fixed contacts (5,6), and a switch module open position (FIGS. 9A, 9B) in which fuse (8) is not connected with the fixed contacts (5,6) and current circulation through the fixed contacts (5,6) is impeded.

The fuse (8) has a longitudinal axis (L) and two connection terminals (9,10) at opposite ends of the fuse (8), so the fuse (8) is detachable from the cartridge (11) by moving the fuse (8) axially in the direction of its longitudinal axis (L) as represented in FIG. 13 G.

In the open position of the switch module, the longitudinal axis (L) of the fuse (8) passes through the aperture (3) so that the fuse can be extracted out of the casing (2) through the aperture (3). In in the closed position of the switch module, the fuse (8) is arranged so that its the longitudinal axis (L) is generally parallel to the aperture (3) preventing the fuse (8) extraction through the aperture.

The cover (4) is pivotably mounted at the aperture (3) with respect to a pivot axis (Y) of the cover (4). The cover (4) and the cartridge (11) are elongated bodies along respective longitudinal axis, and are arranged in a way that the cover (4) and the cartridge (11) in the switch module closed position and when the cover is closing the aperture (3), their longitudinal axis are generally parallel to each other as shown in FIG. 9 C, thus, in that position of the switch module the fuse (8) cannot be extracted through the aperture (3).

Figure 9A:
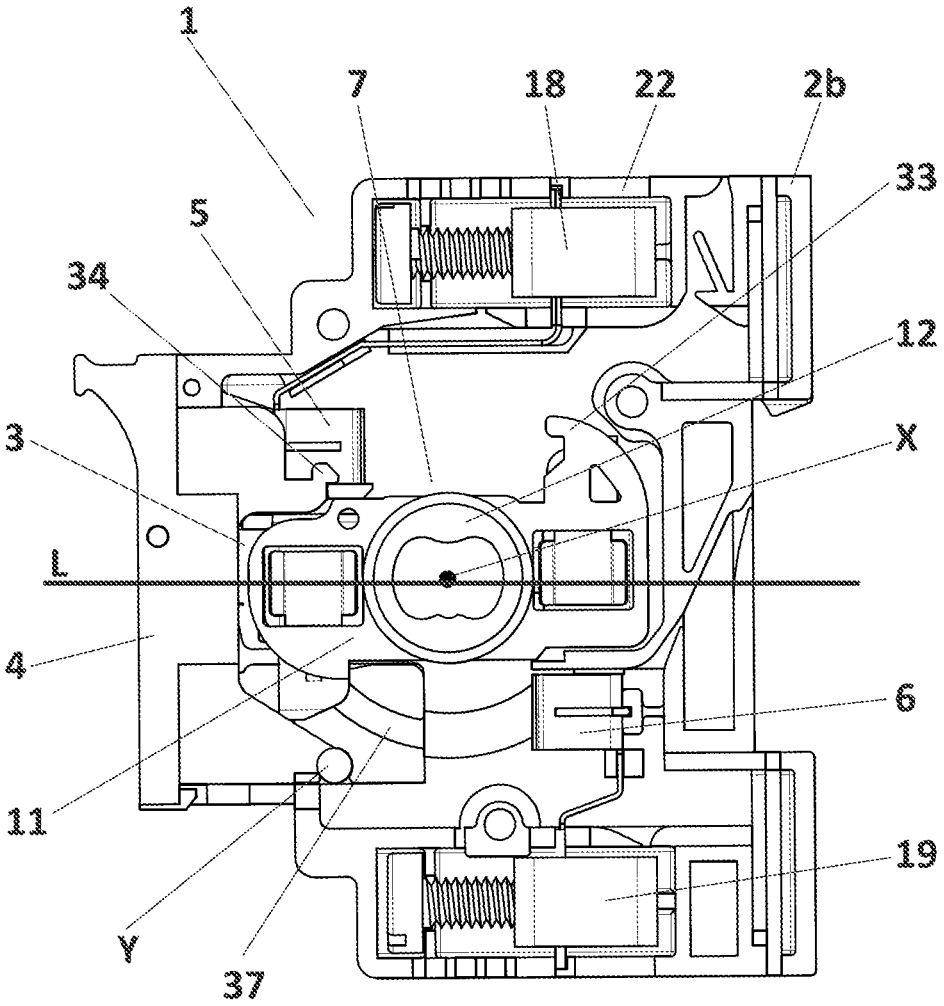
FIG. 9.—illustrates the rotation of the fuse cartridge of the second embodiment between two end positions, and shows in FIGS. 9A, 9B, 9C, three side elevational views with a part of the casing taken off to shows the interior of the module. The fuse cartridge is represented in three positions, in the switch module end open position (FIG. 9A), in the switch module end closed position (FIG. 9C), and in an intermediate position (FIG. 9B) between the two previous positions.
Figure 9B:
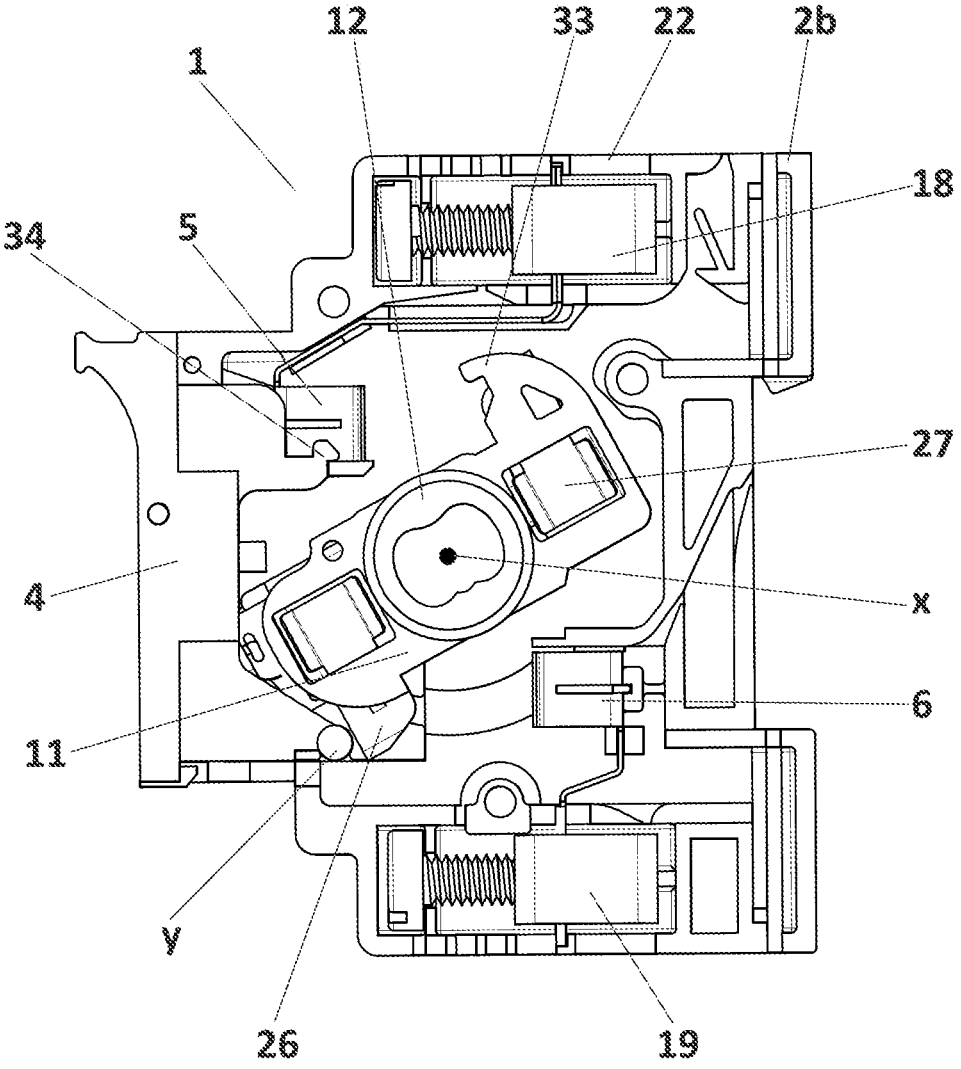
Figure 9C:
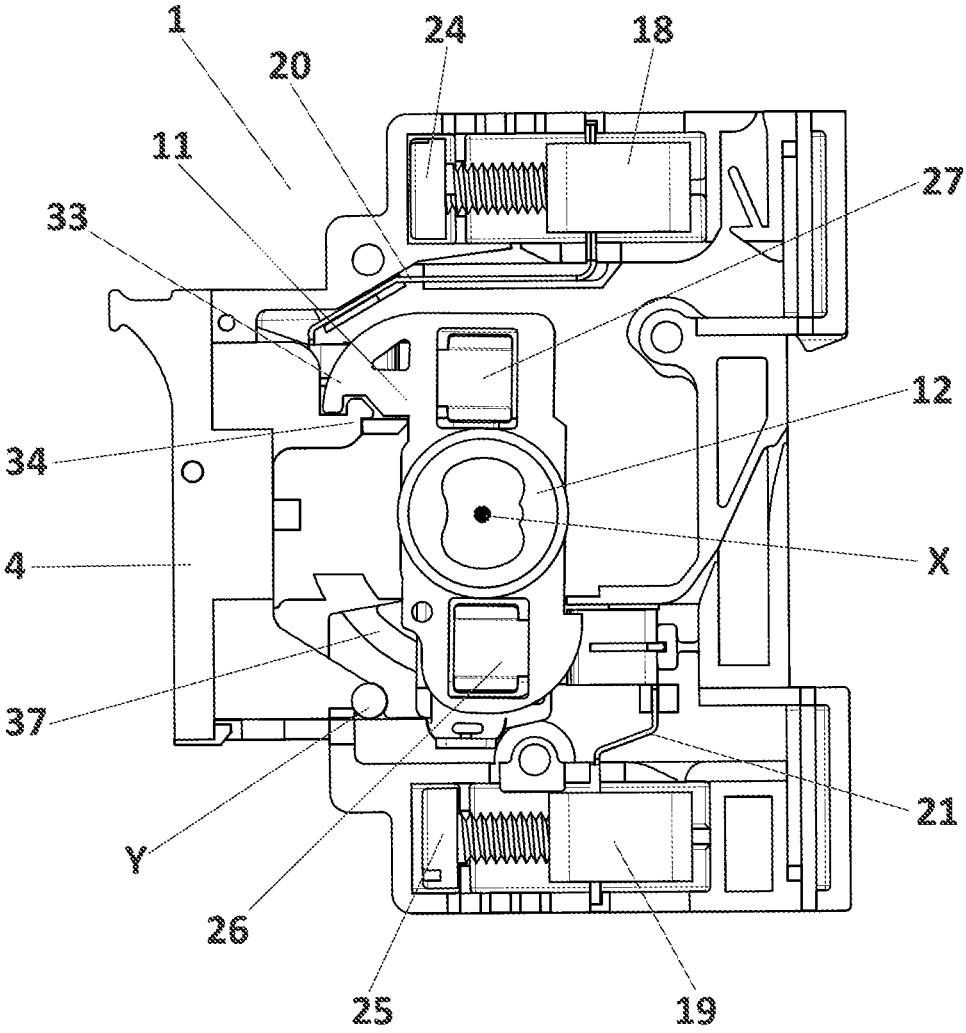
Figure 10A:
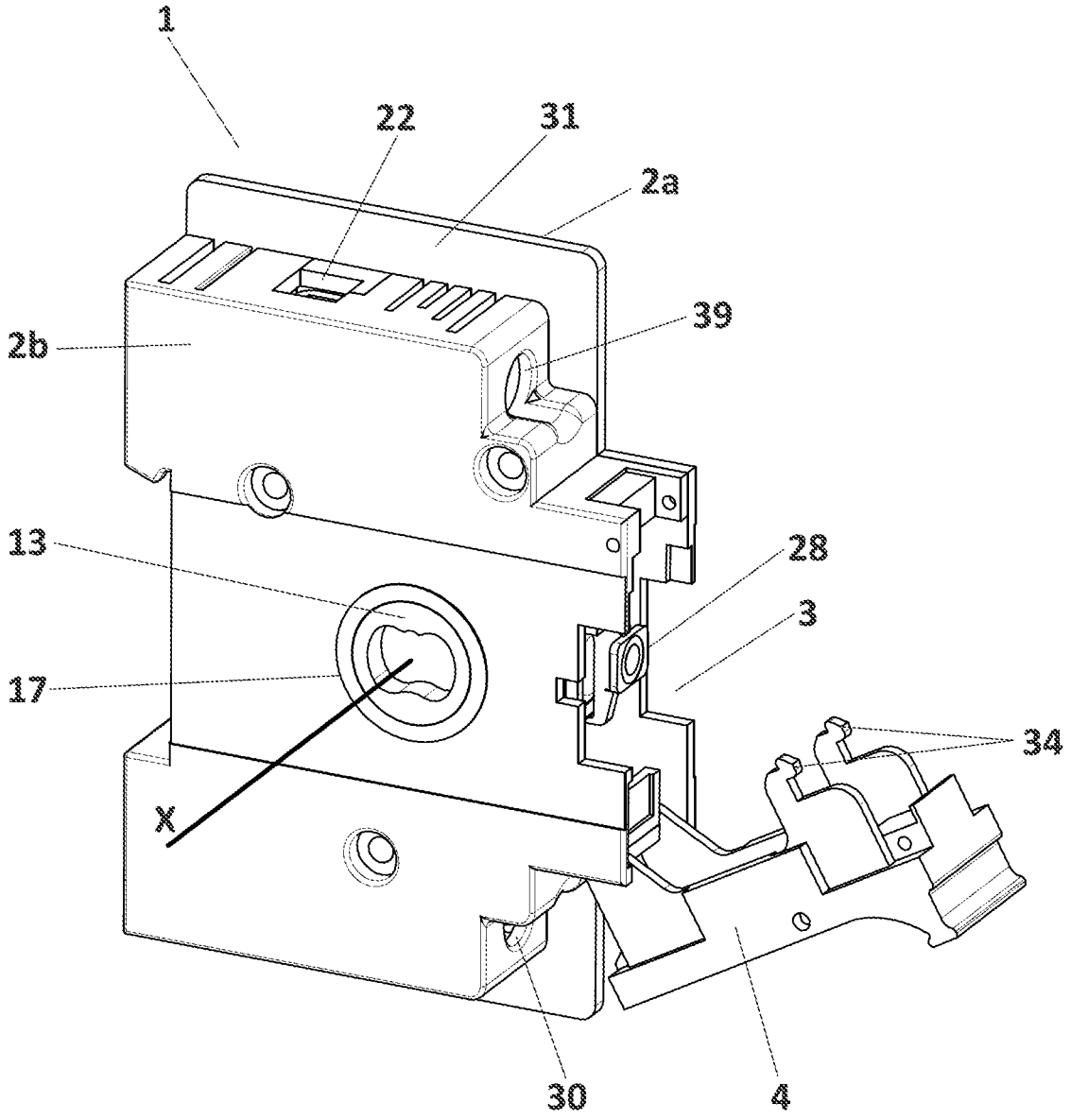
FIG. 10.—illustrates the blocking means to block the fuse cartridge in the second embodiment, and shows in several perspective views the switch module of the with the cover opened (FIG. 10A), with the cover opened and part of the housing removed (FIG. 10B), and with the cover closed and engaged with the cartridge (FIG. 10C).
Figure 10B:
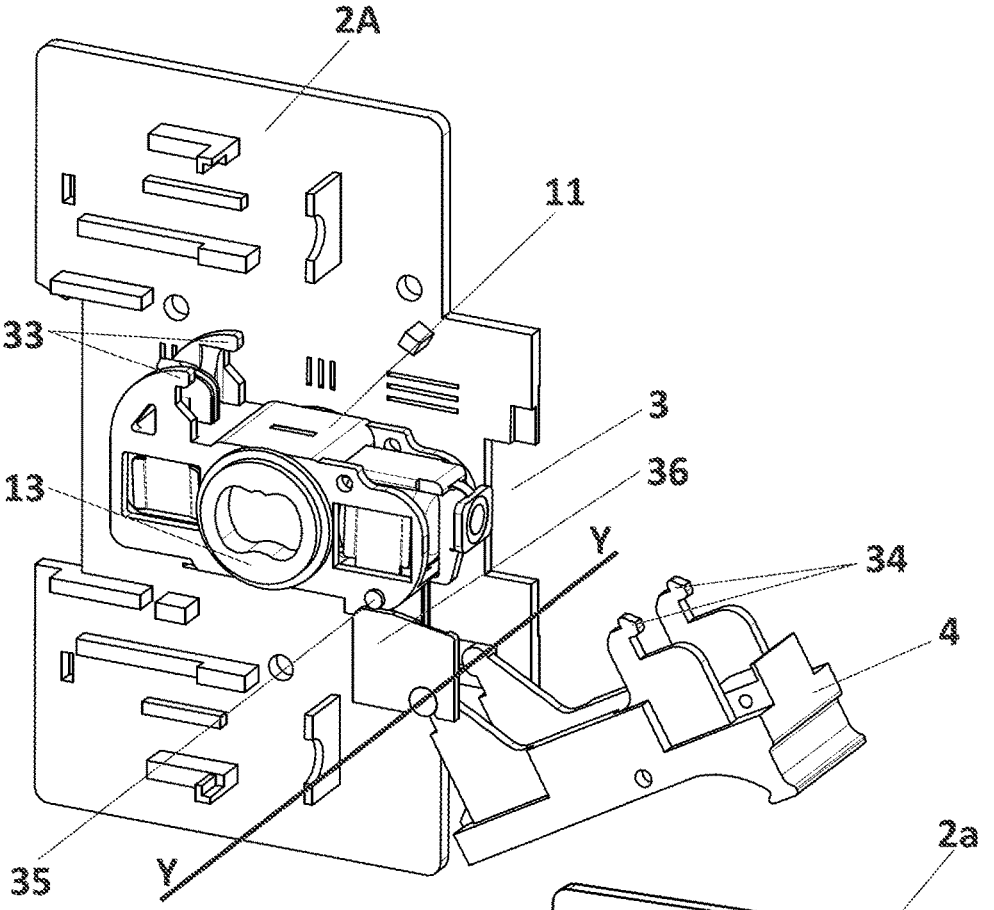
Figure 10C:
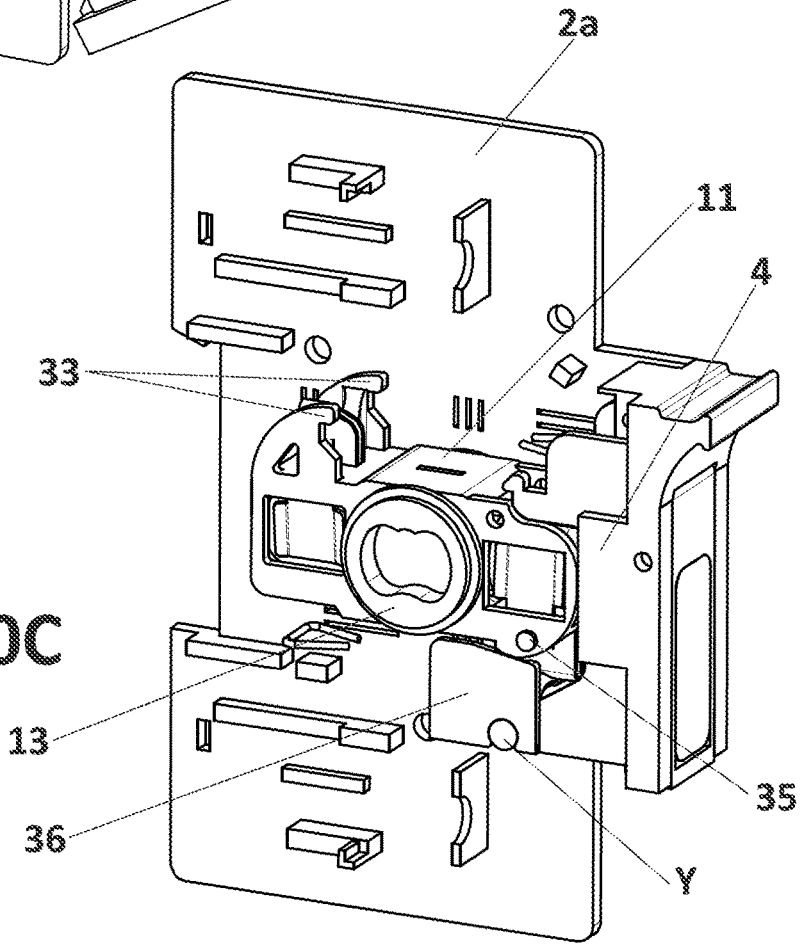

The cover (4) and the fuse cartridge (11) are configured to engage with each other when the cover (4) is closing the aperture (3) and when the fuse cartridge (11) is in the end switch closed position of FIG. 9C, so the cover (4) is locked by the fuse cartridge (11) and opening of the cover (4) is impeded. For that purpose, the cover (4) and the fuse cartridge (11) have interlocking hooks (33,34) that engage with each other in the closed position of the switch module and when the cover (4) is closing the aperture (3) to impede opening of the cover (4), thus, the cover (4) cannot be opened while current is allowed to flow through the fixed contacts.

Figure 12A:
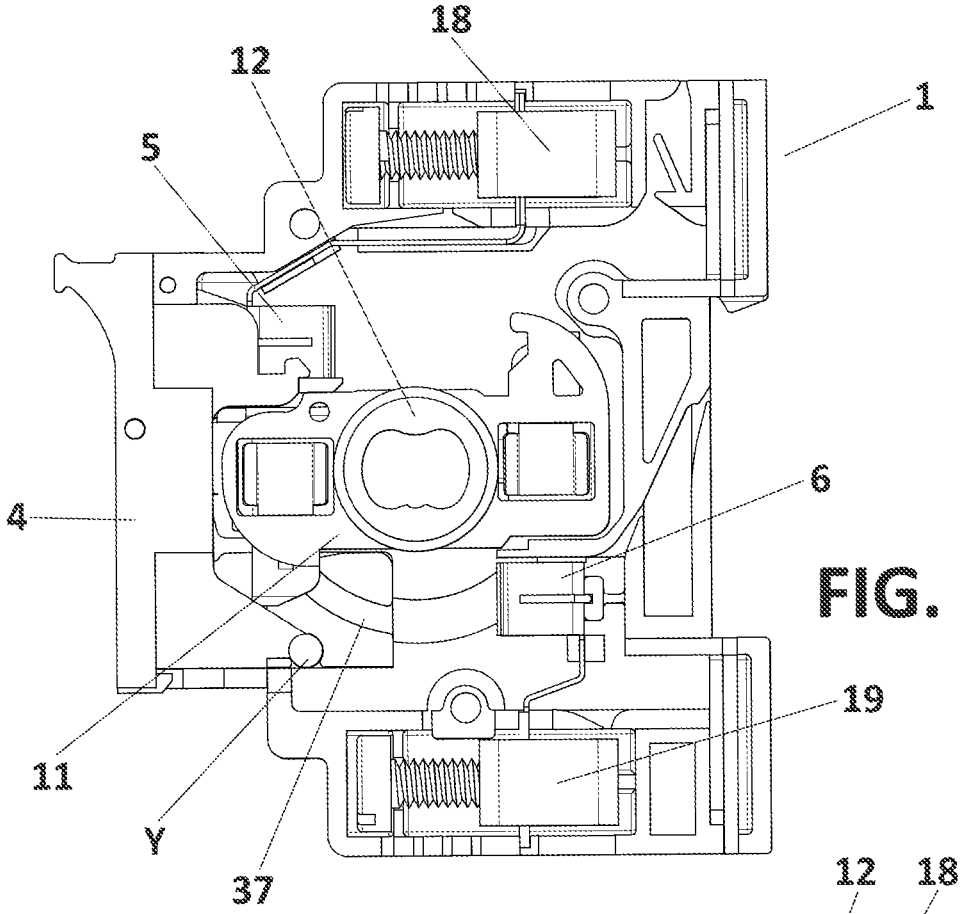
FIG. 12.—illustrates also the operation of the blocking means to block the fuse cartridge in the second embodiment, and shows in FIGS. 12A, 12 B, 12C two side elevational views with a part of the housing removed and different positions of the cover.
FIGS. 12D-G are several perspective views of the fuse cartridge and cover in different positions.
Figure 12B:
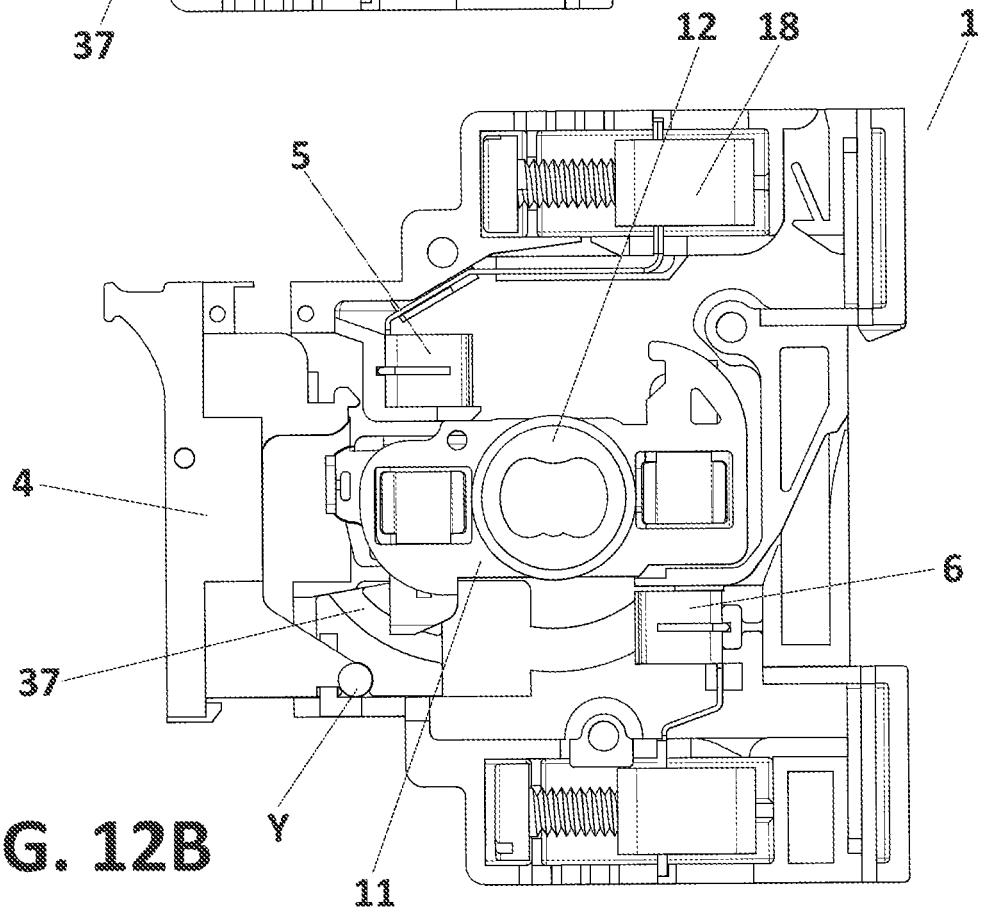
Figure 12C:
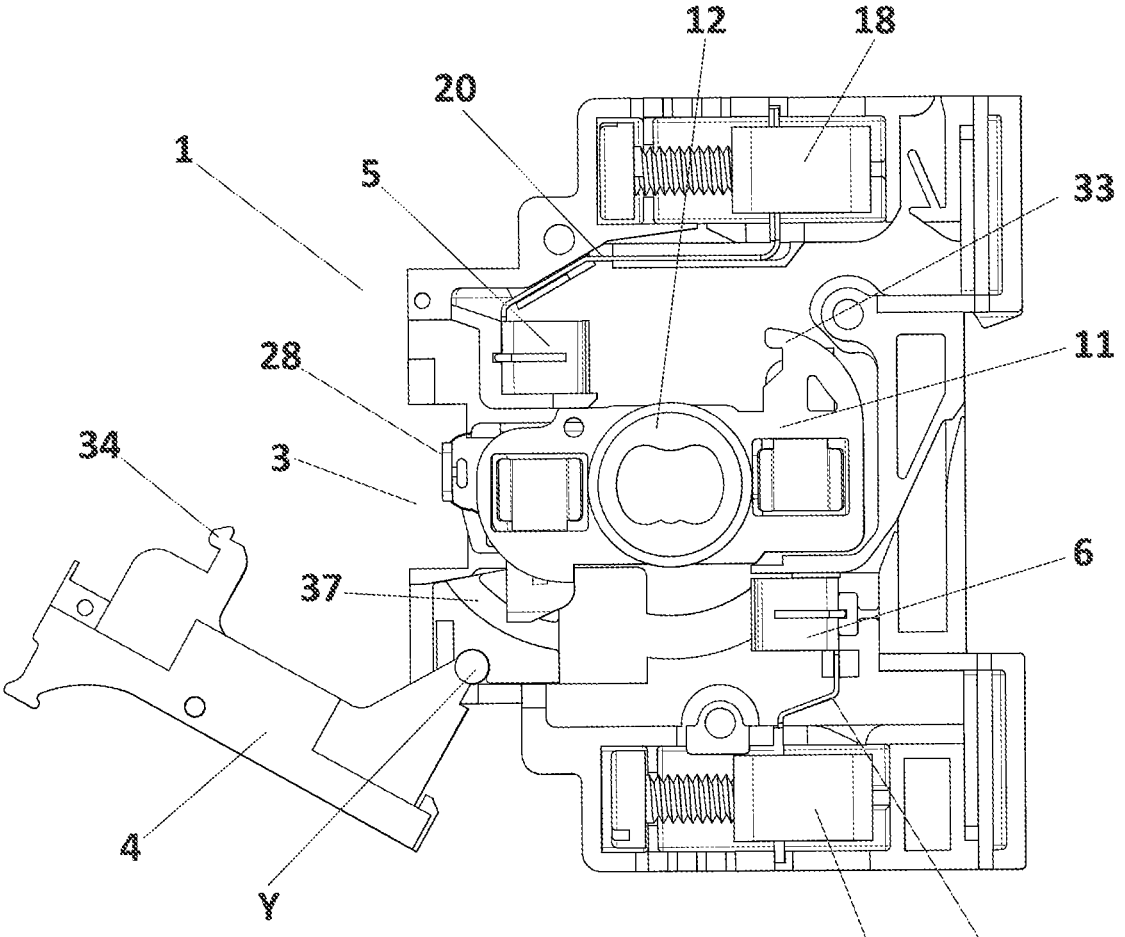
Figure 12D:
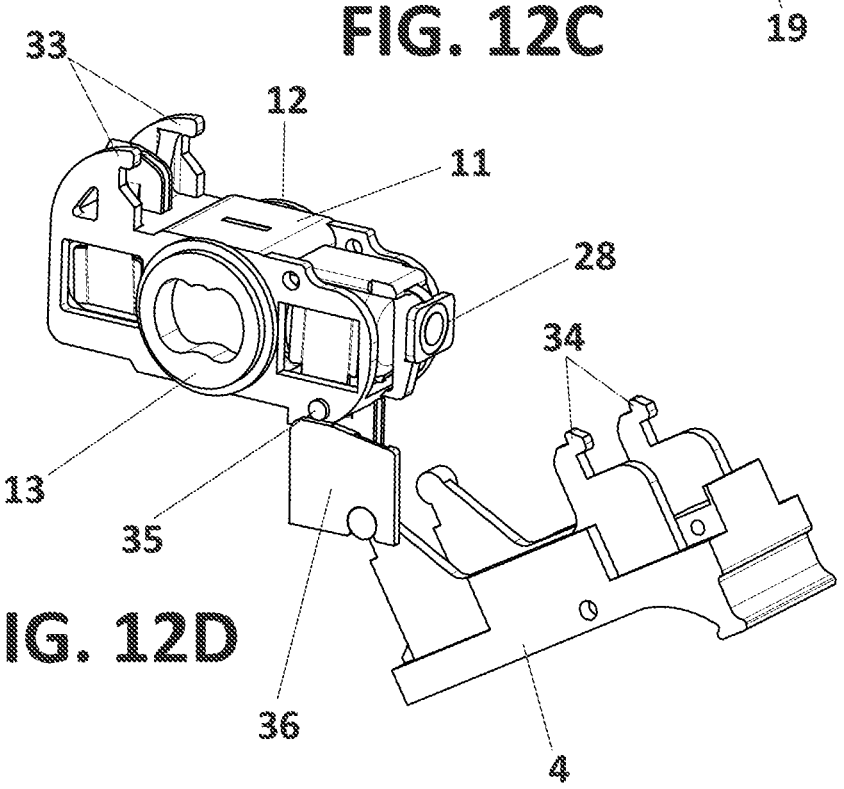
Figure 12E:
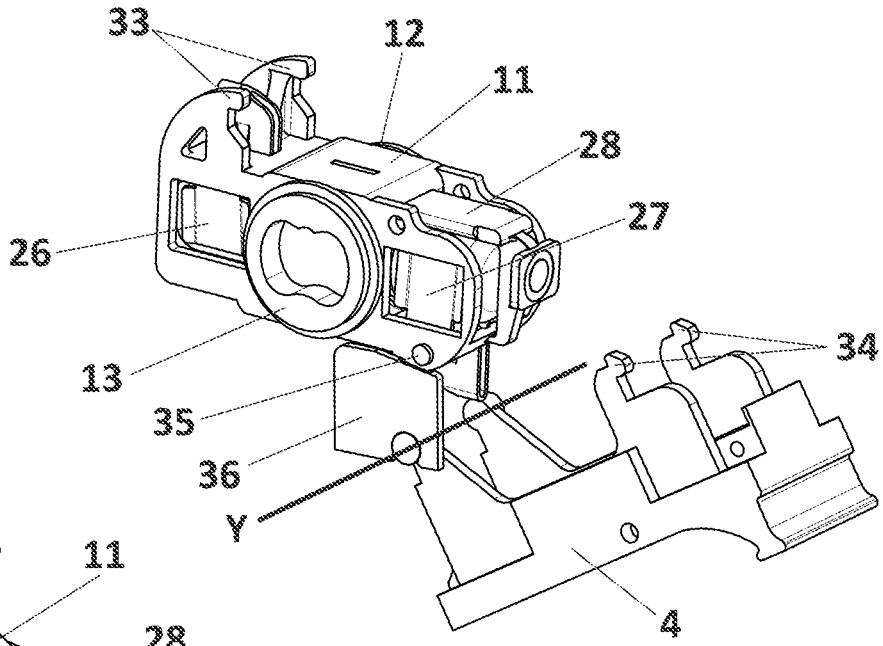
Figure 12F:
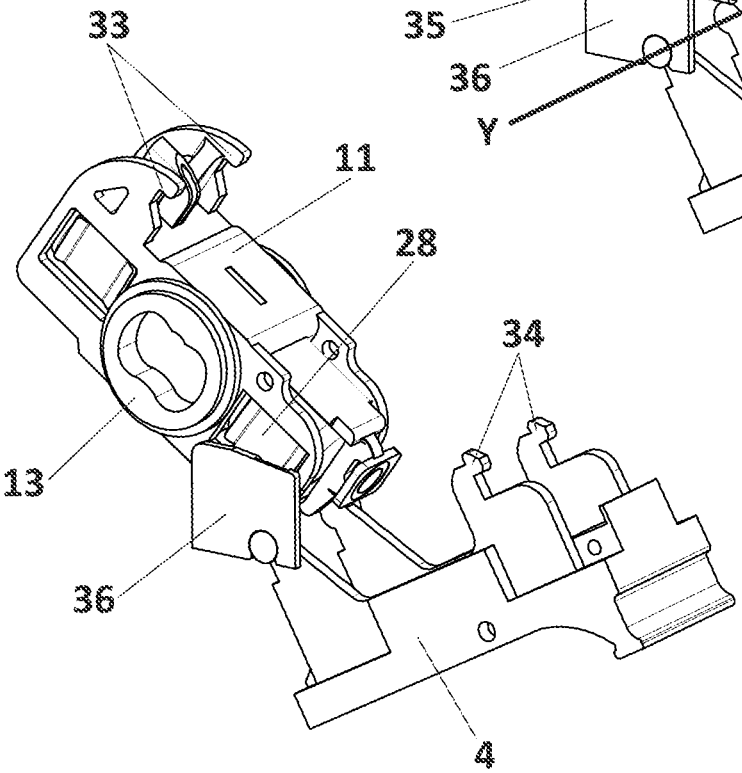
Figure 12G:
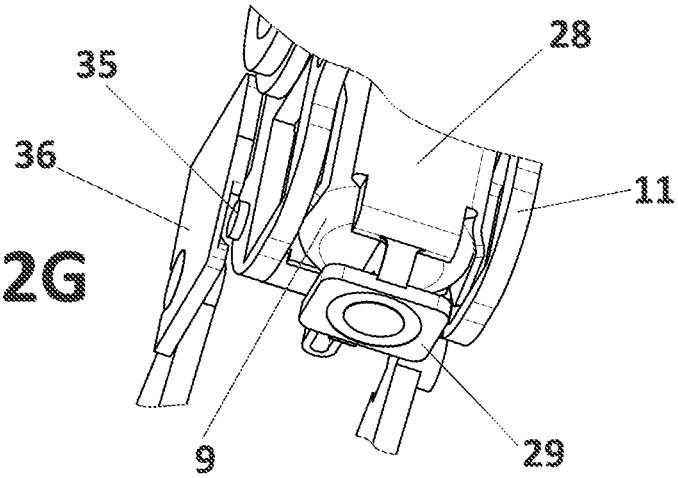

The switch module (1) additionally includes blocking means configured to impede rotation of the fuse cartridge (11) in the open position of the switch module (1) while the cover (4) is opened. These locking means comprise a protrusion (35) in the cartridge (11) and slider (36) movable by the cover (4), wherein the protrusion (35) and slider (36) are configured and arranged, so that when the cover (4) is opened, the slider (36) is positioned to be contacted by the protrusion (35) to block rotation of the fuse cartridge (11) as represented in FIG. 12D, and when the cover (4) is closing the aperture (3), the slider (36) is moved to a position where rotation of the fuse cartridge (11) is allowed as represented in FIGS. 12E,12F,12G.

The slider (36) is a plate connected in an articulated manner with the cover (4) at the pivoting axis (Y) of the cover (4). The slider has a curved groove (37) on one face of the plate so that the protrusion (35) runs along the groove (37) with the movement of the cover (4).

As more clearly shown in FIGS. 11A-F, a pair of conductive blades (26,27) are detachably coupled respectively with the fuse terminals (9,10), and configured for contacting with a fixed contact (5,6) in the closed position of the switch module as it can be appreciated for example in FIG. 9C. Preferably, the conductive blades (26,27) are identical and are obtained with the same manufacturing process and tools, thus, they are copy of each other.

Preferably, the blades (26,27) are obtained by folding or conforming a metallic sheet.

Figure 11A:
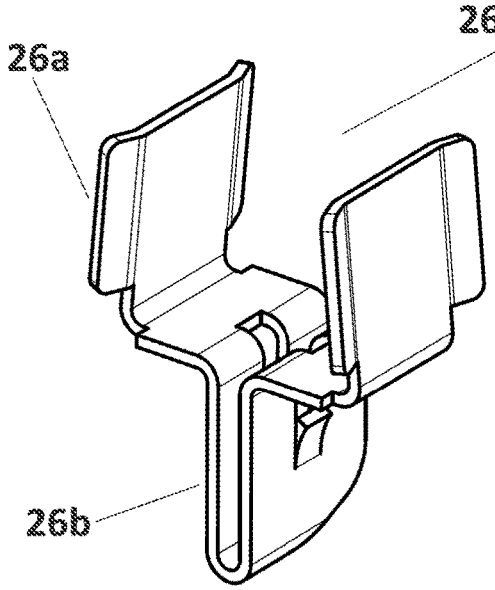
FIG. 11.—illustrates the delayed and advanced arrangements of the conductive blades, and shows in FIG. 11A a perspective view of a conductive blade, a side elevational view in FIG. 11B, and two side elevational views in FIGS. 11C, 11D, of two conductive blades coupled with a fuse in two possible positions.
FIGS. 11E and 11F shows a perspective view and a side elevational views respectively, of two fuses and fixed contacts wherein one of the fuses has the conductive blades arranged in the delayed configuration, and the other fuse has the conductive blades arranged in the advanced configuration.
Figure 11B:
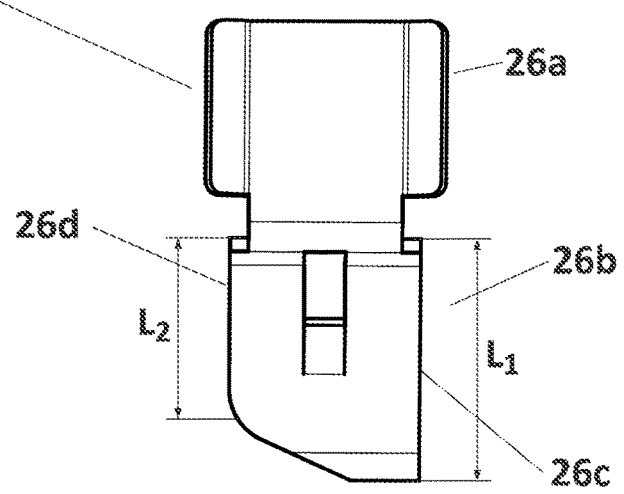

More in detail and in view of FIGS. 11A,11B, each conductive blade (26,27) has a coupling part (26*a*) to be coupled with a fuse terminal (9,10), and a contacting part (26*b*) provided for contacting with a fixed contact (5,6). Each blade (26,27) has generally an "Y" shape in a cross-sectional view of the same, and it is configured so that the coupling part (26*a*) its double-walled part that embraces one of the fuse contacts (9,10) by elastic deformation, and the single-wall part of the blade can be inserted into one of the fixed contacts (5,6).

The contacting part (26*a*) is generally rectangular with a cutout on one of the outer corners, that is, the contacting part (26*a*) is configured to have a long lateral edge (26*c*) of length (L1), and a short lateral edge (26*d*) of length (L2) so length (L1) is larger than (L2). With this configuration, an end part of the long lateral edge (26*c*) is closer to the respective fixed contact (5,6) to be contacted than the short lateral edge (26*d*).

In this second embodiment, the switch module (1) also has a fuse carrier (28) coupled with the fuse (8), the fuse carrier (28) has an end (29) adapted to be gripped and configured to pull the fuse (8) axially out of the fuse cartridge (11). The cover (4) is configured to engage with the fuse carrier (28) when the cover (4) is closing the aperture (3), so that by opening the cover (4) the fuse carrier (28) is pulled out by the cover (4). For that purpose, the switch module (1) incorporates a fuse extractor (38) pivotally mounted with the cover (4) between two end positions, and an extended position (FIGS. 13 C,D,F) generally horizontal, in which it is engaged with the fuse carrier (28) when the cover (4) is closing the aperture (3), and a retracted position (FIGS. 13A, 13B) in which it is distanced from the fuse carrier (28).

Figure 13A:
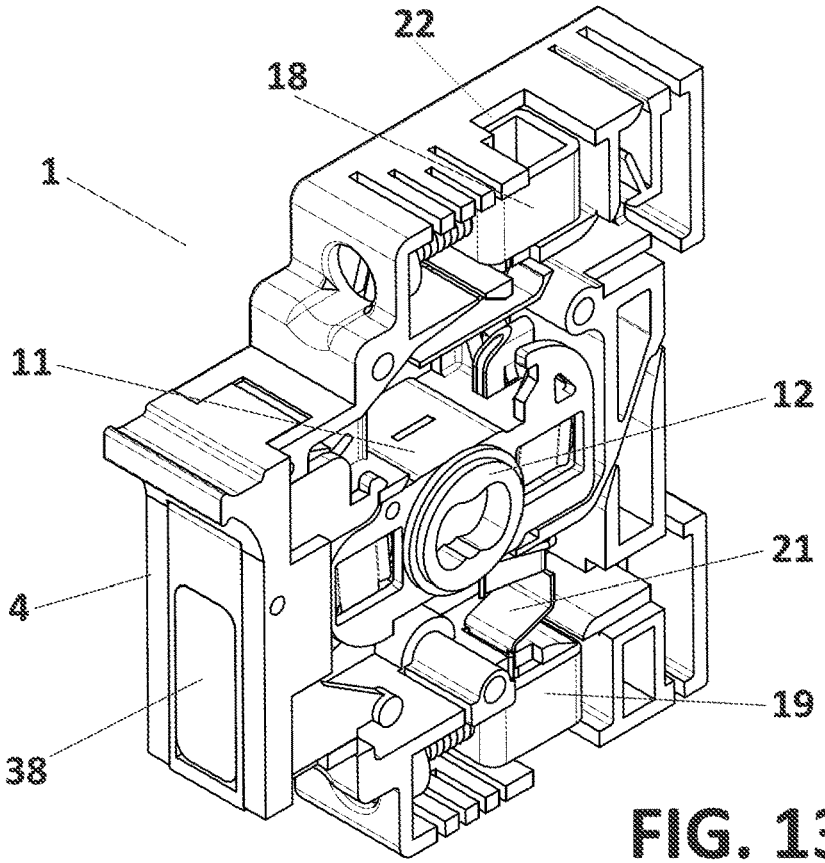
FIG. 13.—illustrates the process of extracting the fuse out of the module in the second embodiment, wherein FIGS. 13 A, C, D, E, F, and G are perspective views.
FIG. 13B is a side cross-sectional view.
Figure 13B:
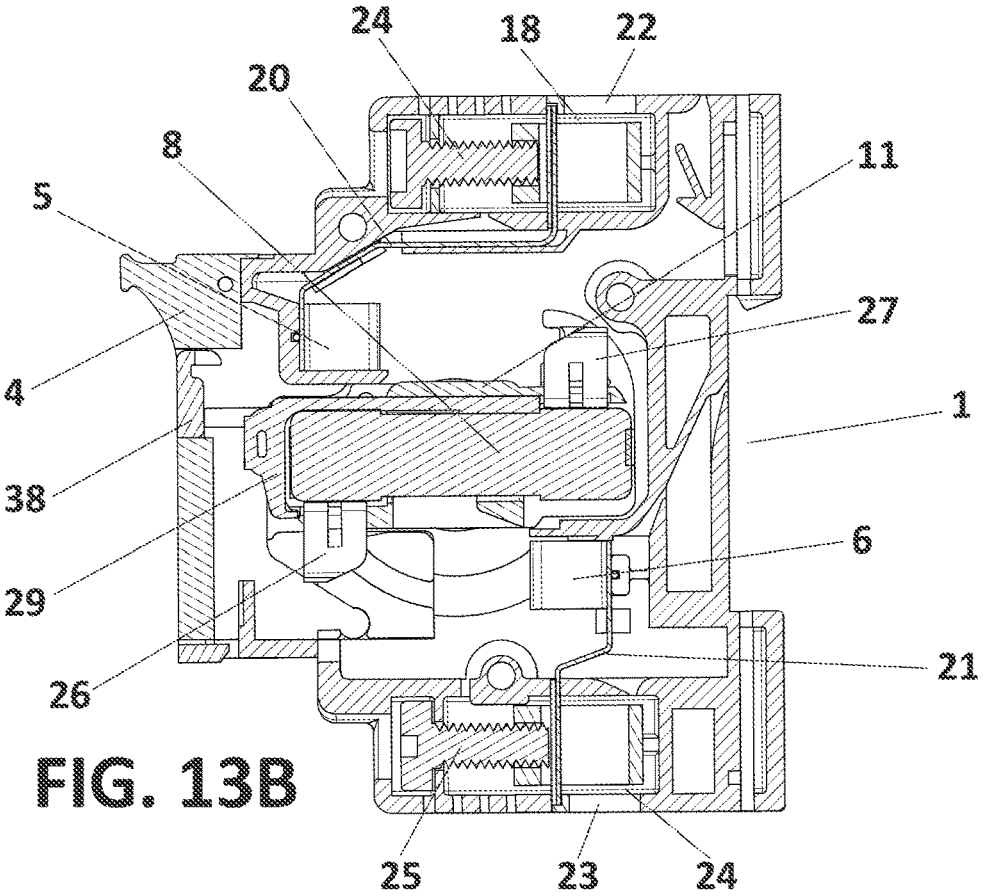
Figure 13C:
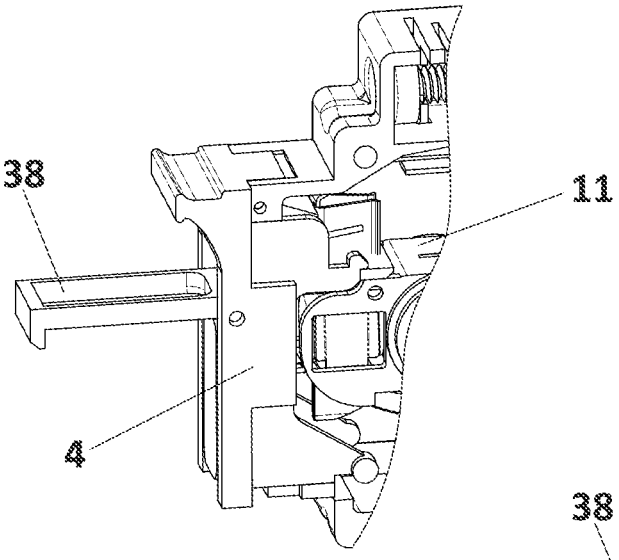
Figure 13D:
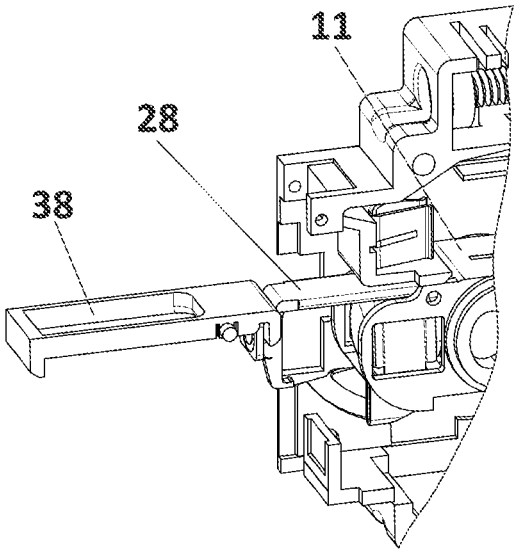
Figure 13E:
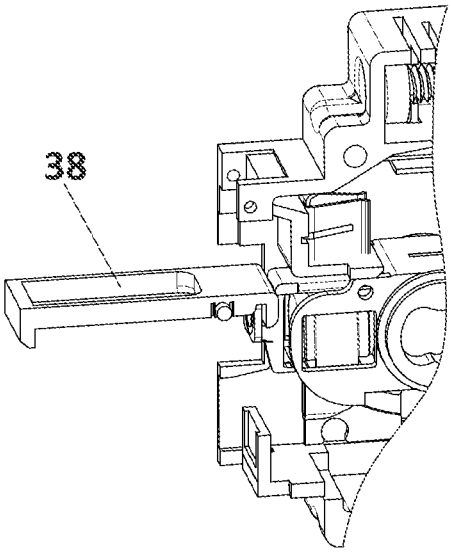
Figure 13F:
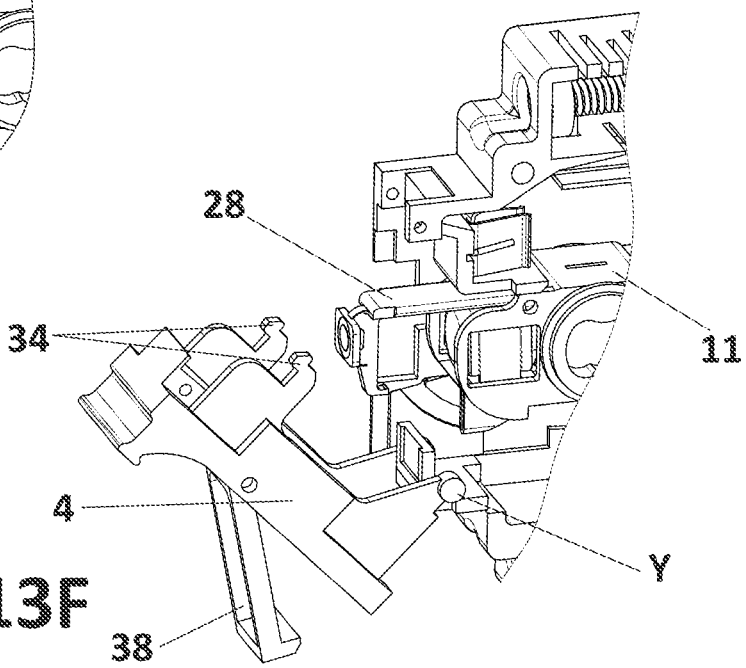
Figure 13G:
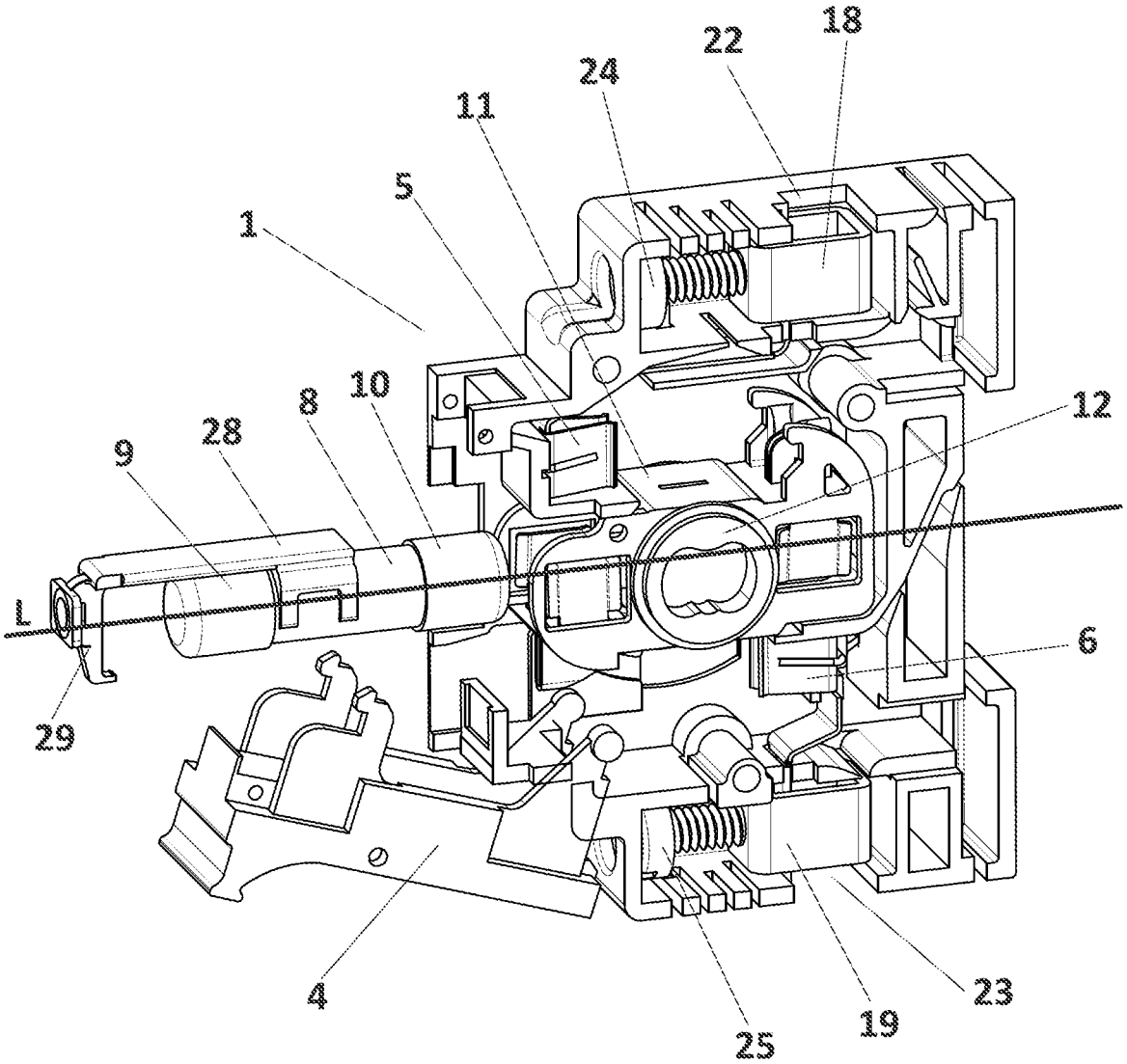

In the retracted position, the fuse extractor (38) is received inside the cover (4) in a window provided in the cover (4) for that purpose, as it can be observed for example in FIGS. 13A,13B.

The fuse cartridge (11) has two protrusions (12,13) having a bore (14,15) for receiving an actuation member for operating the switch module (1). These protrusions (12,13) are received within a circular apertures (16,17) formed at opposite lateral walls of the casing (2) and are accessible from the outside the casing (2), such as rotation of the fuse cartridge (11) is guided by the apertures (16,17).

A switch assembly or a switch array (32) as the one shown in FIG. 14, is formed in a known manner by stacking side by side and co-axially several switch modules (1) as the one described above, together with an actuation mechanism (not shown) having a shaft coupled axially with respect the axis (X) and with the with fuse cartridges (11) so the fuse cartridges (11) of the switch modules rotate simultaneously.

Figure 11C:
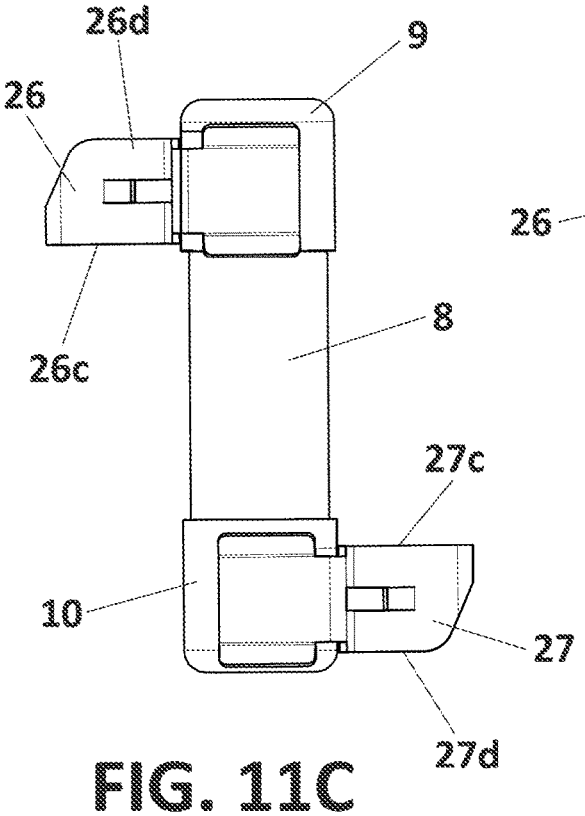
Figure 11D:
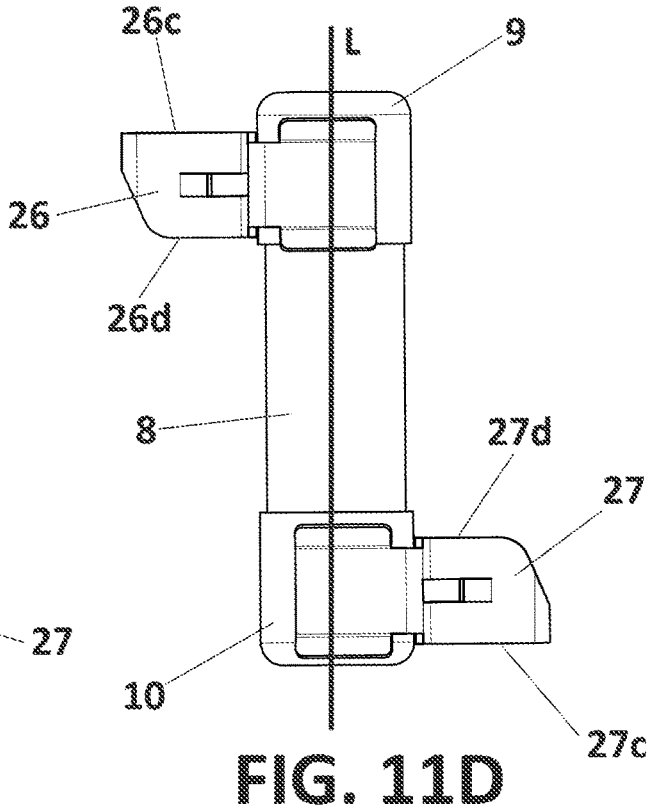

Each fuse cartridge (11) has a fuse (8) received therein and conductive blades (26,27) coupled respectively with the fuse terminals (9,10). At least one of the switch modules (1) of the assembly has the two fuse cartridges (11) arranged so that the long lateral edges of the two conductive blades (26,27) are closer to the center of the fuse than the short lateral edges (advanced arrangement) as shown in FIG. 11C. Furthermore, at least one of the switch modules (1) has the two conductive blades (26,27) arranged so that the long lateral edges of the two conductive blades (26,27) are closer to the fuse free opposite ends than the short lateral edges (delayed arrangement) as shown in FIG. 11D, thereby obtaining an assembly of switch modules as the one shown in FIGS. 11E,11F.

Figure 11E:
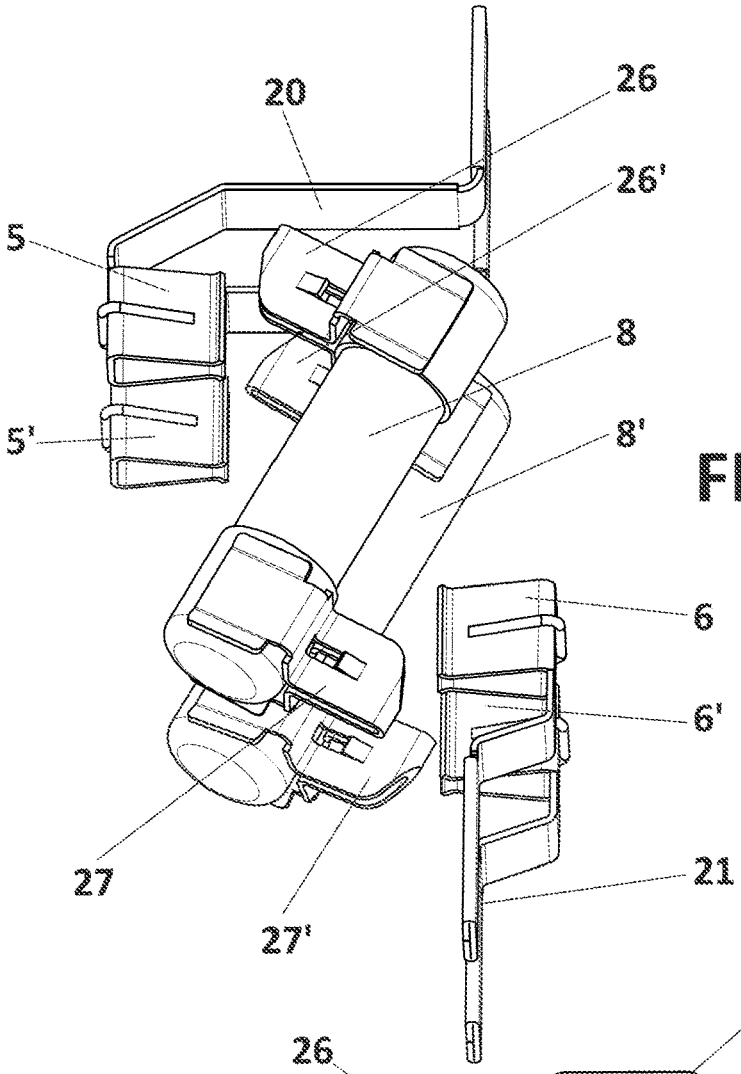
Figure 11F:
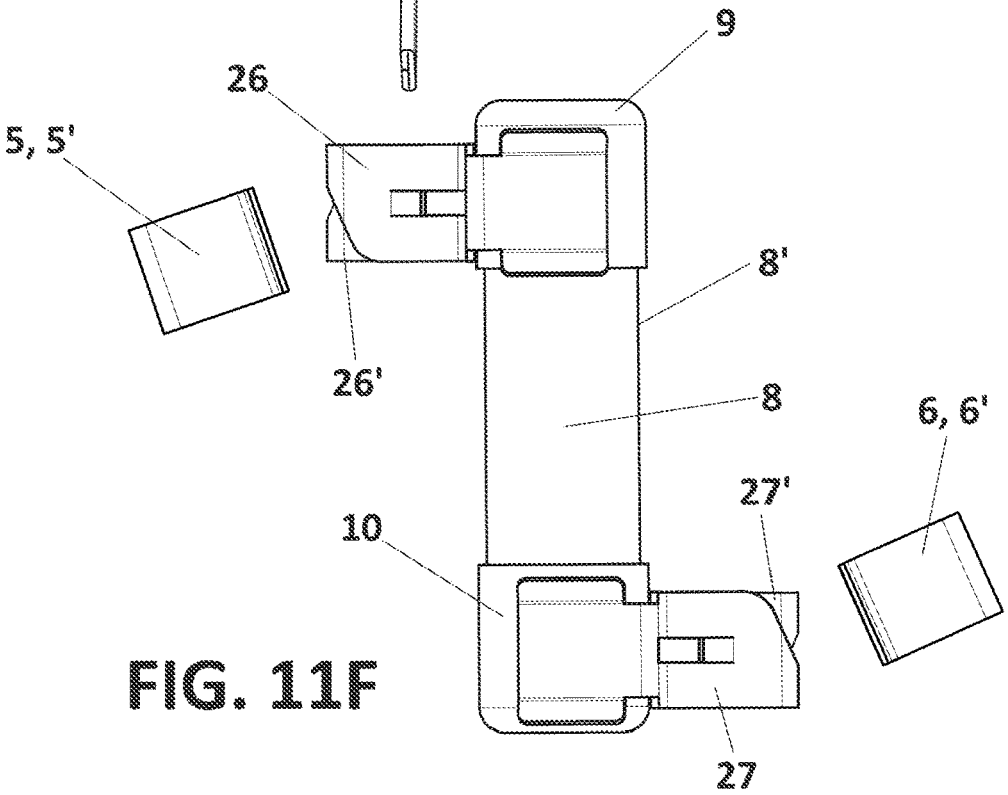

It would be noted in view of FIGS. 11E,11F that the second fuse (8') having the conductive blades (26',27') in the advanced arrangement described above, would contact with the respective fixed contacts (5',6') before the first fuse (8) having the conductive blades (26,27) in the delayed arrangement described above, since the tip of the long edges of the conductive blades (26",27") are closer to the fixed contacts (5',6') than the tip of the long edges of the conductive blades (26,27) to their fixed contacts (5,6) considering that all the fixed contacts are equal and are in the same position.

In the switch assembly of FIG. 14 one switch module has the (advanced arrangement) and it is the neutral o common pole of the assembly, and the three other switch modules are the three other poles of a three-phase electric system. The neutral pole would be connected always before the other three poles, and the neutral pole would be disconnected after the other three poles, implementing thereby in a simple manner an additional safety feature of the switch assembly.

Other preferred embodiments of the present invention are described in the appended dependent claims and the multiple combinations of those claims.

The invention claimed is:

1. A fuse switch module, comprising:

an electrically insulating casing having an aperture providing access to a casing interior, and a cover installed at the aperture in movable manner for opening and closing the aperture;

a pair of fixed contacts inside the casing; and a rotatable fuse cartridge made of an electrically insulating material inside the casing, wherein the rotatable fuse cartridge is adapted for receiving a fuse, so that when the fuse is received in the rotatable fuse cartridge, the fuse and the rotatable fuse cartridge are jointly rotatable;

wherein the rotatable fuse cartridge is rotatable between a fuse switch module closed position in which the fuse is connected with the pair of fixed contacts to enable current circulation through the fuse and the pair of fixed contacts when the fuse is received in the rotatable fuse cartridge, and a fuse switch module open position in which the current circulation through the pair of fixed contacts is impeded;

wherein the cover and the rotatable fuse cartridge are configured to engage with each other, when the cover closes the aperture and when the rotatable fuse cartridge is in the fuse switch module closed position, such that the cover is locked by the rotatable fuse cartridge and opening of the cover is impeded.

2. The fuse switch module according to claim 1, wherein the cover and the rotatable fuse cartridge have interlocking hooks that engage with each other, when the rotatable fuse cartridge is in the fuse switch module closed position and when the cover closes the aperture, to impede opening of the cover.

3. The fuse switch module according to claim 1, further comprising the fuse received in the rotatable fuse cartridge, the fuse having a longitudinal axis and two connection terminals at opposite ends of the fuse, and wherein the fuse is detachable from the rotatable fuse cartridge by moving the fuse axially in a direction of its longitudinal axis.

4. The fuse switch module according to claim 3, configured in such a way that, when the rotatable fuse cartridge is in the fuse switch module closed position, the two connection terminals of the fuse are respectively connected with the pair of fixed contacts to enable the current circulation through the pair of fixed contacts, and, when the rotatable fuse cartridge is in the fuse switch module open position, the connection terminals of the fuse are separated from the pair of fixed contacts to prevent the current circulation.

5. The fuse switch module according to claim 3, configured in such a way that, when the rotatable fuse cartridge is in the fuse switch module open position, the longitudinal axis of the fuse passes through the aperture so that the fuse can be extracted out of the casing through the aperture, and, when the rotatable fuse cartridge is in the fuse switch module closed position, the fuse is arranged so that its the longitudinal axis is generally parallel to the aperture, preventing fuse extraction through the aperture.

6. The fuse switch module according to claim 1, further comprising blocking means configured to impede rotation of the rotatable fuse cartridge when the rotatable fuse cartridge is in the fuse switch module open position and while the cover is open.

7. The fuse switch module according to claim 6, wherein the blocking means comprises a protrusion in the rotatable fuse cartridge and a slider movable by the cover, wherein the protrusion and the slider are configured and arranged so that when the cover is opened, the slider is positioned to be contacted by the protrusion to block rotation of the rotatable fuse cartridge, and when the cover closes the aperture, the slider moved to a position where rotation of the rotatable fuse cartridge is allowed.

8. The fuse switch module according to claim 7, wherein the cover is pivotably mounted at the aperture, and wherein the slider is a plate connected in an articulated manner with a pivot axis of the cover, and wherein the slider has a curved groove on one of the plate faces so that the protrusion runs along the groove with the movement of the cover.

9. The fuse switch module according to claim 1, wherein the cover and the rotatable fuse cartridge each include elongated bodies extending along respective longitudinal axes, and wherein the longitudinal axes of the cover and the rotatable fuse cartridge, when the rotatable fuse cartridge is in the fuse switch module closed position and when the cover closes the aperture, are parallel to each other.

10. The fuse switch module according to claim 1, wherein the rotatable fuse cartridge is rotatable about a rotation axis located in-between the pair of fixed contacts and transversal to a longitudinal axis of the rotatable fuse cartridge, and wherein the rotatable fuse cartridge rotates about the rotation axis and an angle within a range of 45°-90° between the fuse switch module closed and open positions.

11. The fuse switch module according to claim 10, wherein the angle is 90°.

12. The fuse switch module according to claim 1, further comprising a pair of conductive blades detachably coupled respectively with the fuse terminals, and configured for contacting with the pair of fixed contacts when the rotatable fuse cartridge is in the fuse switch module closed position, wherein each conductive blade of the pair of conductive blades has a coupling part to be coupled with a fuse terminal and a contacting part provided for contacting with a fixed contact of the pair of fixed contacts, and wherein the contacting part has a long lateral edge and a short lateral edge, such that an end part of the long lateral edge is closer to the respective fixed contact of the pair of fixed contacts to be contacted.

13. The fuse switch module according to claim 12, wherein the pair of conductive blades are identical.

14. The fuse switch module according to claim 1, further comprising a fuse carrier coupled with the fuse, the fuse carrier having an end adapted to be gripped and configured to pull the fuse axially out of the rotatable fuse cartridge, wherein the cover is configured to engage with the fuse carrier when the cover closes the aperture, so that by opening the cover the fuse carrier is pulled out by the cover.

15. The fuse switch module according to claim 14, further comprising a fuse extractor pivotally mounted to the cover, the fuse extractor configured to rotate with respect to the cover between an engaged position, in which the fuse extractor is engaged with the fuse carrier when the cover closes the aperture, and a disengaged position, in which the fuse extractor is distanced from the fuse carrier.

16. The fuse switch module according to claim 1, wherein the rotatable fuse cartridge has at least one protrusion having a bore for receiving an actuation member for operating the fuse switch module, and wherein the at least one protrusion is received within a circular aperture formed at a wall of the casing and being accessible from the outside the casing, such that rotation of the rotatable fuse cartridge is guided by the aperture.

17. A switch assembly, comprising:

at least two fuse switch modules, each of the at least two fuse switch modules including:

an electrically insulating casing having an aperture providing access to a casing interior, and a cover installed at the aperture in movable manner for opening and closing the aperture;

a pair of fixed contacts inside the casing; and a rotatable fuse cartridge made of an electrically insulating material inside the casing, wherein the rotatable fuse cartridge is adapted for receiving a fuse, so that when the fuse is received in the rotatable fuse cartridge, the fuse and the rotatable fuse cartridge are jointly rotatable;

wherein the rotatable fuse cartridge is rotatable between a fuse switch module closed position in which the fuse is connected with the pair of fixed contacts to enable current circulation through the fuse and the pair of fixed contacts when the fuse is received in the rotatable fuse cartridge, and a fuse switch module open position in which the current circulation through the pair of fixed contacts is impeded;

wherein the cover and the rotatable fuse cartridge are configured to engage with each other, when the cover closes the aperture and when the rotatable fuse cartridge is in the fuse switch module closed position, such that the cover is locked by the rotatable fuse cartridge and opening of the cover is impeded;

wherein the at least two fuse switch modules are assembled about a common operating axis, and wherein the rotatable fuse cartridges of the fuse switch modules are coupled so as to simultaneously rotate, wherein the rotatable fuse cartridges have respective fuses received therein and respective conductive blades coupled respectively with the fuse terminals, and wherein at least one of the fuse switch modules has the two conductive blades arranged so that the long lateral edges of the two conductive blades are closer to the center of the fuse than the short lateral edges, and wherein at least one of the fuse switch modules has the two conductive blades arranged so that the long lateral edges of the two conductive blades are closer to the fuse free opposite ends than the short lateral edges.

* * * * *